US008397826B2

(12) United States Patent
O'Connor et al.

(10) Patent No.: US 8,397,826 B2
(45) Date of Patent: Mar. 19, 2013

(54) PUMP DOWN LINER EXPANSION METHOD

(75) Inventors: Keven O'Connor, Houston, TX (US); Mark K. Adam, Houston, TX (US); Matthias R. Moeller, Braunschweig (DE); Joerg Lehr, Celle (DE)

(73) Assignee: Baker Hughes Incorporated, Houston, TX (US)

( * ) Notice: Subject to any disclaimer, the term of this patent is extended or adjusted under 35 U.S.C. 154(b) by 331 days.

(21) Appl. No.: 12/882,942

(22) Filed: Sep. 15, 2010

(65) Prior Publication Data

US 2012/0061097 A1 Mar. 15, 2012

(51) Int. Cl.
*E21B 29/00* (2006.01)

(52) U.S. Cl. ..... 166/380; 166/207

(58) Field of Classification Search ..... 166/380, 166/384, 207

See application file for complete search history.

(56) References Cited

U.S. PATENT DOCUMENTS

| | | | | |
|---|---|---|---|---|
| 6,702,029 | B2 * | 3/2004 | Metcalfe et al. | 166/378 |
| 7,007,760 | B2 | 3/2006 | Lohbeck et al. | |
| 7,240,731 | B2 | 7/2007 | Carmody et al. | |
| 7,255,176 | B2 | 8/2007 | Adam et al. | |
| 7,370,699 | B2 | 5/2008 | Adam et al. | |
| 7,380,604 | B2 | 6/2008 | Adam et al. | |
| 7,458,422 | B2 | 12/2008 | Adam et al. | |
| 7,552,772 | B2 | 6/2009 | Carmody et al. | |
| 7,708,060 | B2 | 5/2010 | Adam et al. | |
| 7,730,955 | B2 | 6/2010 | Farquhar et al. | |
| 2005/0161226 | A1 | 7/2005 | Duggan et al. | |
| 2009/0229835 | A1 | 9/2009 | Filippov | |
| 2012/0085549 | A1 * | 4/2012 | O'Connor et al. | 166/380 |

FOREIGN PATENT DOCUMENTS

EP 2202383 A1 6/2010

* cited by examiner

*Primary Examiner* — William P Neuder
(74) *Attorney, Agent, or Firm* — Steve Rosenblatt

(57) ABSTRACT

A string to be expanded is run in with a running string that supports a swage assembly. The running string is secured to the existing tubular and the top of the string to be expanded is sealed around the supported running string. The pressure applied to the annular space above the seal drives the liner over the swage. A cement shoe is affixed to the lower end of the string that is expanded after becoming detached from the running string assembly. When the expanded liner bottoms on a support, generally the hole bottom, the cement is delivered through the shoe and the expansion of the top of the string into a recess of the string above continues. The swage assembly with the seal and the anchor are then recovered as the running string is removed during the process of expanding the top of the expanded string into the lower end recess of the existing string already in the wellbore.

23 Claims, 25 Drawing Sheets

PUMP DOWN LINER EXPANSION METHOD

FIELD OF THE INVENTION

The field of the invention is a method of expansion of tubulars downhole and more particularly expanding one tubular into contact with an open hole section where the added tubular is expanded into a supporting position by advancing the new tubular by moving it over an expansion device

BACKGROUND OF THE INVENTION

Monobore applications using expansion have integrated cementing through a shoe while covering a recess at the end of an existing string with a removable cover that comes off after cementing. A string with a swage is placed in position and the swage is energized to grow in diameter before being advanced through the newly added tubular until the swage exits the top of the added tubular to fixate it into the recess at the lower end of the existing tubular. The result is a monobore well. These designs have also disclosed a deployable shoe that can be delivered with the string prior to expansion and then tagged and retained as a swage moves through the string only to be reintroduced into the expanded string and sealingly fixated to it for the cementing operation. Examples of one or more of these method steps are illustrated in U.S. Pat. Nos. 7,730,955; 7,708,060; 7,552,772; 7,458,422; 7,380,604; 7,370,699; 7,255,176 and 7,240,731.

Methods that advance a swage through a tubular require the rig equipment to not only support the weight of the string to be expanded but also to be able to handle the applied force to the swage to advance it through the tubular to enlarge the diameter. The present invention reduces the surface equipment capacities needed to perform an expansion to create, for example, a monobore. It entails bracing the workstring to an existing tubular with the string to be expanded inside the existing tubular. The annulus around the work string is sealed and the swage is retained as annulus pressure around the running string advances the string to be expanded with respect to the stationary swage. Subsequently the expanded string is cemented and the expansion is completed by swage movement to exit the tubular that is now expanded, cemented and joined to the existing tubular. The bottom hole assembly that was used to deliver and expand the tubular into a supporting position is then retrieved to the surface. More details of the method will become readily apparent to those skilled in the art from a review of the detailed description of the preferred embodiment and the associated drawings while understanding that the full scope of the invention is to be determined from the literal and equivalent scope of the appended claims.

SUMMARY OF THE INVENTION

A string to be expanded is run in with a running string that supports a swage assembly. The running string is secured to the existing tubular and the top of the string to be expanded is sealed around the supported running string. The pressure applied to the annular space above the seal drives the liner over the swage. A cement shoe is affixed to the lower end of the string that is expanded after becoming detached from the running string assembly. When the expanded liner bottoms on a support, generally the hole bottom, the cement is delivered through the shoe and the expansion of the top of the string into a recess of the string above continues. The swage assembly with the seal and the anchor are then recovered as the running string is removed during the process of supporting the top of the expanded string to the lower end recess of the existing string already in the wellbore.

DETAILED DESCRIPTION OF THE PREFERRED EMBODIMENT

Figures 1, 2, 3, 4, 5, 6:
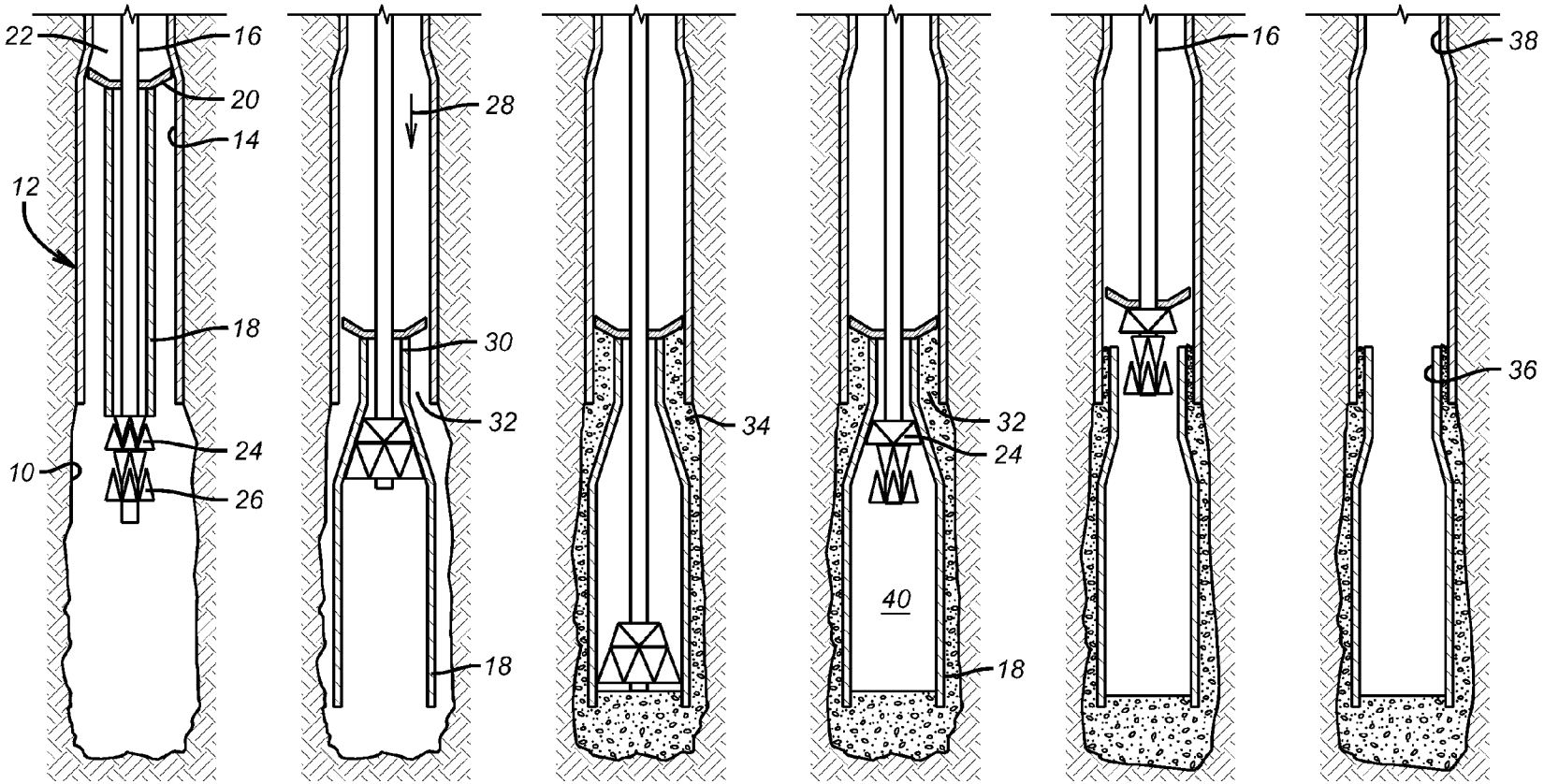
FIG. 1 is a simplified diagram of the method showing the string to be expanded delivered to within the string that exists in the wellbore.
FIG. 2 is the view of FIG. 1 showing the string advanced over the swage assembly for expansion of the tubular string.
FIG. 3 is the view of FIG. 2 showing the cementing process.
FIG. 4 is the view of FIG. 3 showing the swage assembly raised to a location where expansion of the top of the string into a recess of the existing tubular can take place.
FIG. 5 is the view of FIG. 4 and shows the expansion assembly coming through the string at the close of expansion with the two strings joined and the expanded string cemented.
FIG. 6 is the view of FIG. 5 with the running string and expansion assembly fully removed.

A very simplified version of the method is illustrated in FIGS. 1-6 to show in general terms how it operates. A borehole 10 extends past an existing tubular 12 that has a recess 14 near its lower end. The recess 14 could have been placed there with an expansion tool that expanded the string 12 after it was originally placed in position in the wellbore 10. A running string 16 delivers a string to be expanded 18 and has a top end seal 20 to close off the annulus 22. Near the lower end of the running string 16 is a smaller swage 24 and a larger swage 26 shown in the collapsed condition. Preferably the swages are made of wedge segments that slide axially relative to each other to change between a collapsed dimension and an expansion dimension. The strings 18 and 16 can be coiled or jointed tubing. The string 18 can also have either a round or folded cross-section.

In FIG. 2 the pressure has been applied as indicated by arrow 28 to move the string 18 in a downward direction. Such movement acts to enlarge the swages to their desired diameters for expansion. The upper end 30 is not yet expanded leaving a gap 32 for fluid displacement when cementing begins as depicted in FIG. 3.

In FIG. 3 the string 16 is tagged into a cement shoe that is not shown and cement is delivered into the annulus 34. At the conclusion of cementing in FIG. 4, the string 16 is released from the shoe (not shown) and the swages 24 and 26 are raised in a manner that only swage 24 is deployed. The cement in the unexpanded annulus 32 will remain in place until squeezed out of the liner top during liner lap expansion. The swage 24 is either pulled by string 16 or is driven up by pressure delivered through string 16 to below swage 26 to drive the swages 24 and 26 out through the string 18 to close the gap 32 as shown in FIG. 5. FIG. 6 shows the expansion assembly removed and the resulting wellbore completed as a monobore with the drift diameter at 36 at least as large as the diameter at 38.

From the detail offered thus far it can be seen that the string 18 is advanced over a stationary swage assembly 24 and 26 that is initially located below the existing tubular 12 that has a lower end recess 14. After cementing, the balance of the expansion can take place by advancing the swages 24 in the expanded position and 26 in the collapsed position by literally pulling on the running string 16 or by delivering pressure though the running string 16 to then drive up the swage 24 by pressurizing space 40 that is below and within the string 18.

Figure 7A:
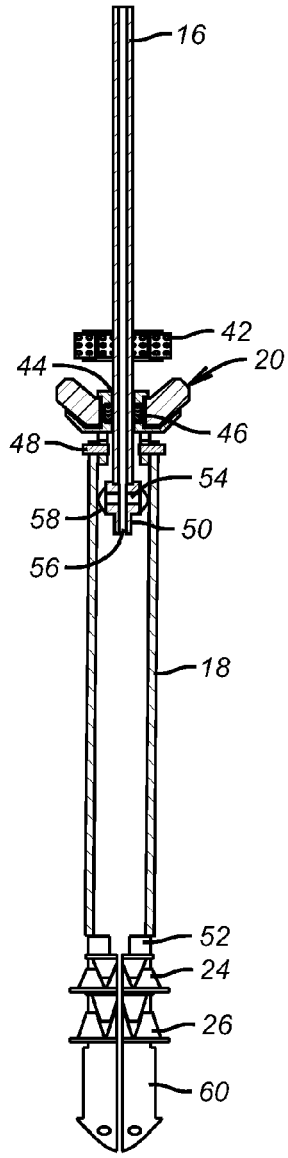
FIG. 7*a* is a view of the assembly at the bottom of the string to be expanded and the components that interact with those components that are located at the lower end of the running string.

In order to understand the details of the method, a more specific explanation of some of the introduced components will follow that also adds some new components. The detailed functioning of all the components will then be developed as the step by step description that then follows. Repeated in FIG. 7*a* from FIGS. 1-6 are the liner 18 that is to be expanded with the swages 24 and 26. The seal 20 seals around the running string 16. The remaining components will now be introduced and discussed in greater detail. A selectively deployed anchor 42 is attached to the running string 16 and can be selectively deployed to the existing string 12 as will be explained below. The seal 20 has a central passage 44 and a stack of chevron seals 46 or some equivalent seal so that a seal can be maintained in annuls 22 as pressure represented by arrow 28 is applied and the seal 20 moves with the string 18 relatively to the stationary pipe 16. It is preferred that the length of the running string 16 over which the seals 46 will travel should be polished to enhance sealing for at least the travel length of movement of seals 46 on the outside surface of the string 16. The seal assembly 20 is secured to the string 18 by a breakable connection 48. A connector tool 50 is at the lower end of the string 16 and can selectively engage the receptacle 52 above swage 24. The connector tool 50 has lateral passages 54 and a through passage 56. A series of bow springs 58 can serve as a centralizer as well as any equivalent device so that tagging into the receptacle 52 can be facilitated. A cement shoe 60 is schematically illustrated below the swage 26. As will be explained below, the shoe 60 is designed to separate from the string 16 and sealingly anchor to the expanded portion at the lower end of the string 18 as will be explained in more detail below.

Figure 7B:
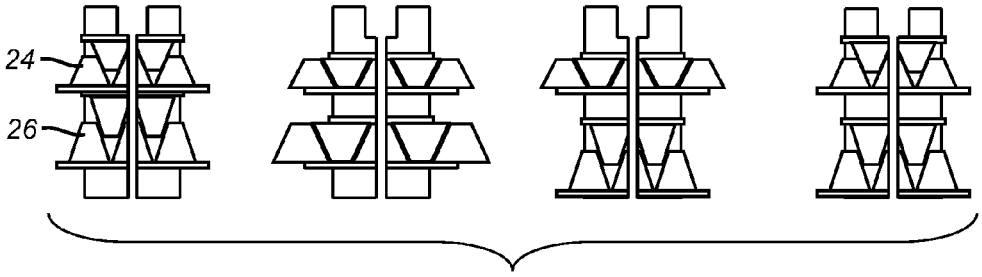
FIG. 7*b* shows the various configuration of the dual swage assembly in the various steps of the method.

FIG. 7*b* shows the four positions of the swages 24 and 26 during the practice of the method. In the first view both are collapsed for run in. In the second view both are expanded for initial expansion by the string 18 moving past as pressure is applied above seal 20 as indicated by arrow 28. In the third view only swage 24 is activated for the finish of the expansion of the string 18 by either pulling with string 16 or pushing from behind swage 24 with pressure delivered through string 16 as swage 24 holds a seal against string 18 for the finish of expansion. In the final view both swages 24 and 26 are again collapsed for removal from the now secured string 18.

FIGS. 8-30 detail the method for using coiled tubing for the liner 18 but the method is applicable to jointed tubing as well but different surface equipment will be used. The string 18 can be circular when run in or folded in a general figure eight shape as indicated by 62. The main difference between using rounded string 18 to a folded version for running in is that the folded version 62 will need dual running strings 16 to reside in the wide portions of the figure eight shape to ensure that the folded shape transitions to round and that the expansion swage is loaded in a symmetrical manner.

Figure 8:
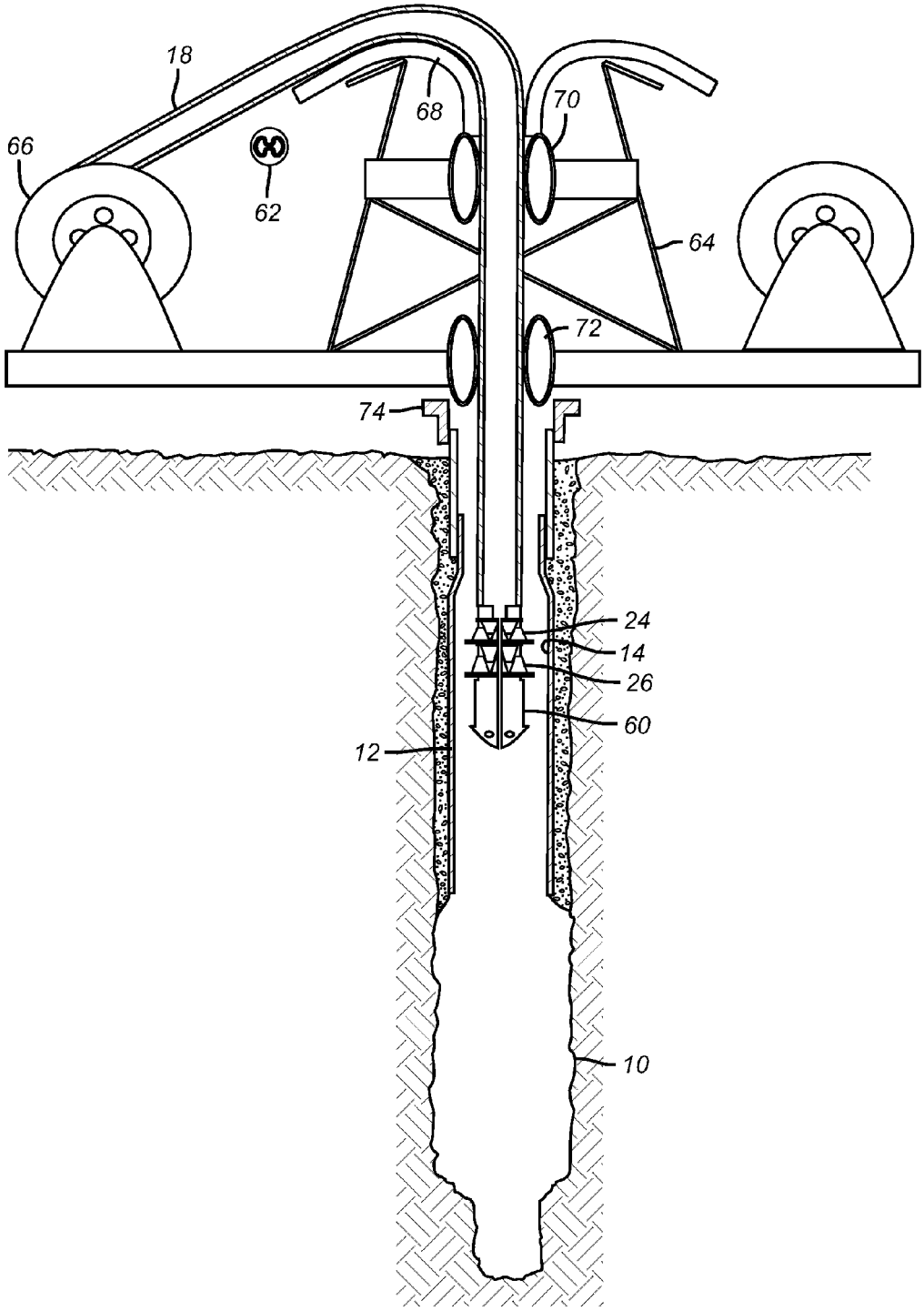
FIG. 8 shows running in a coiled tubing version of the string to be expanded.

In FIG. 8 a rig 64 is in position over the borehole 10. Spool 66 has the string 18 that wraps around it and feeds out through a guide 68 and then through injectors 70 and 72. It should be noted that typical well control equipment such as blowout preventers are omitted for clarity and added to that the drawings are also somewhat schematic so that details are omitted that are not significant to understanding the operation of the method. A flange 74 will subsequently accept a stuffing box as will be discussed with regard to FIG. 13. The existing tubular 12 is already in position with a lower end recess 14. The swages 24 and 26 and the shoe 60 are connected to the lower end of the string 18 before running into the wellbore 10.

Figure 9:
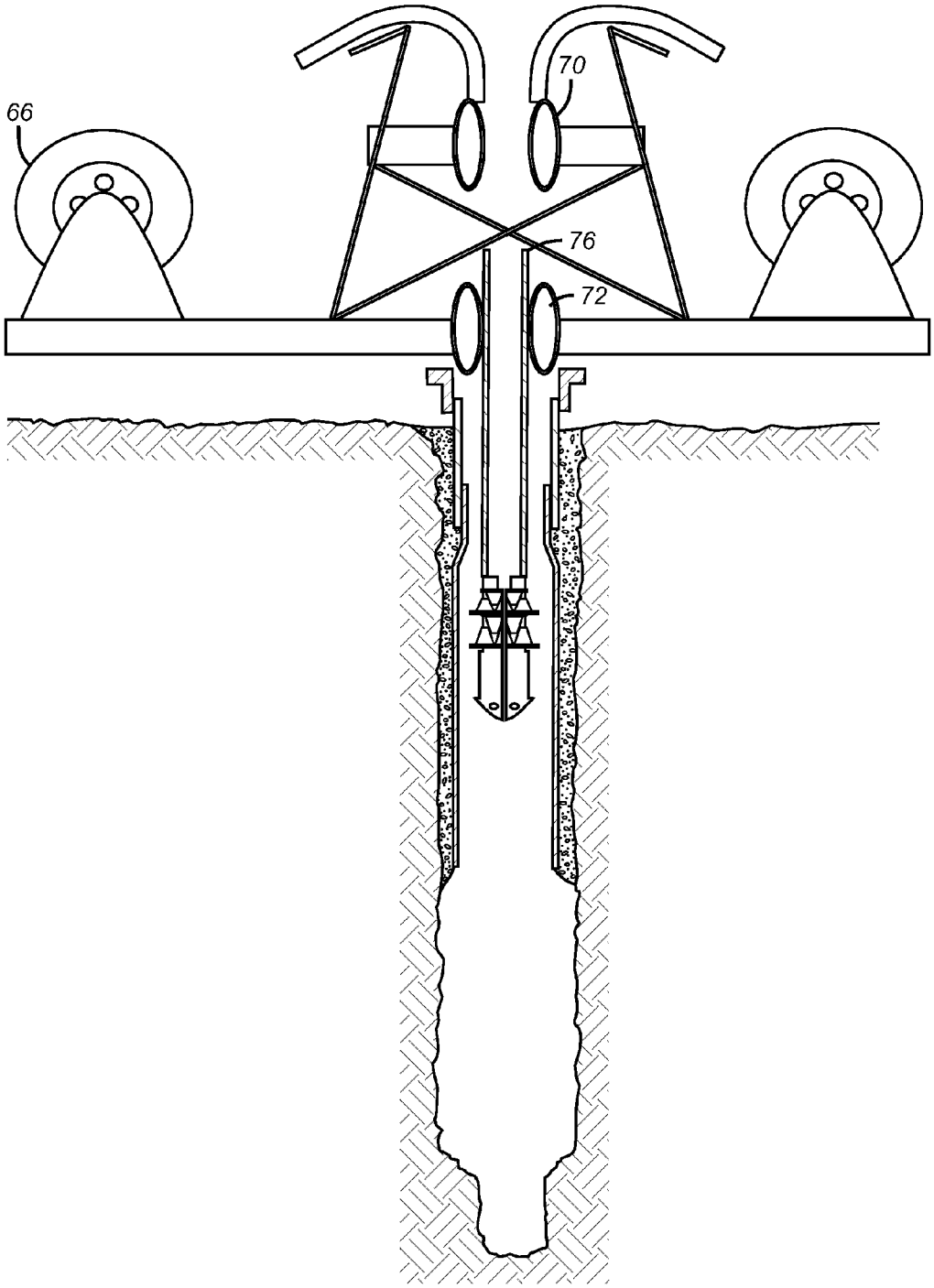
FIG. 9 shows the top of the string to be expanded being cut in an injector assembly.

In FIG. 9 the string 18 is cut at 76 when the appropriate length has been fed off the spool 66. The cut is made between the guides 70 and 72 and the cut end is dressed to sealingly accept the seal assembly 20 as will be discussed with regard to FIG. 10.

Figure 10:
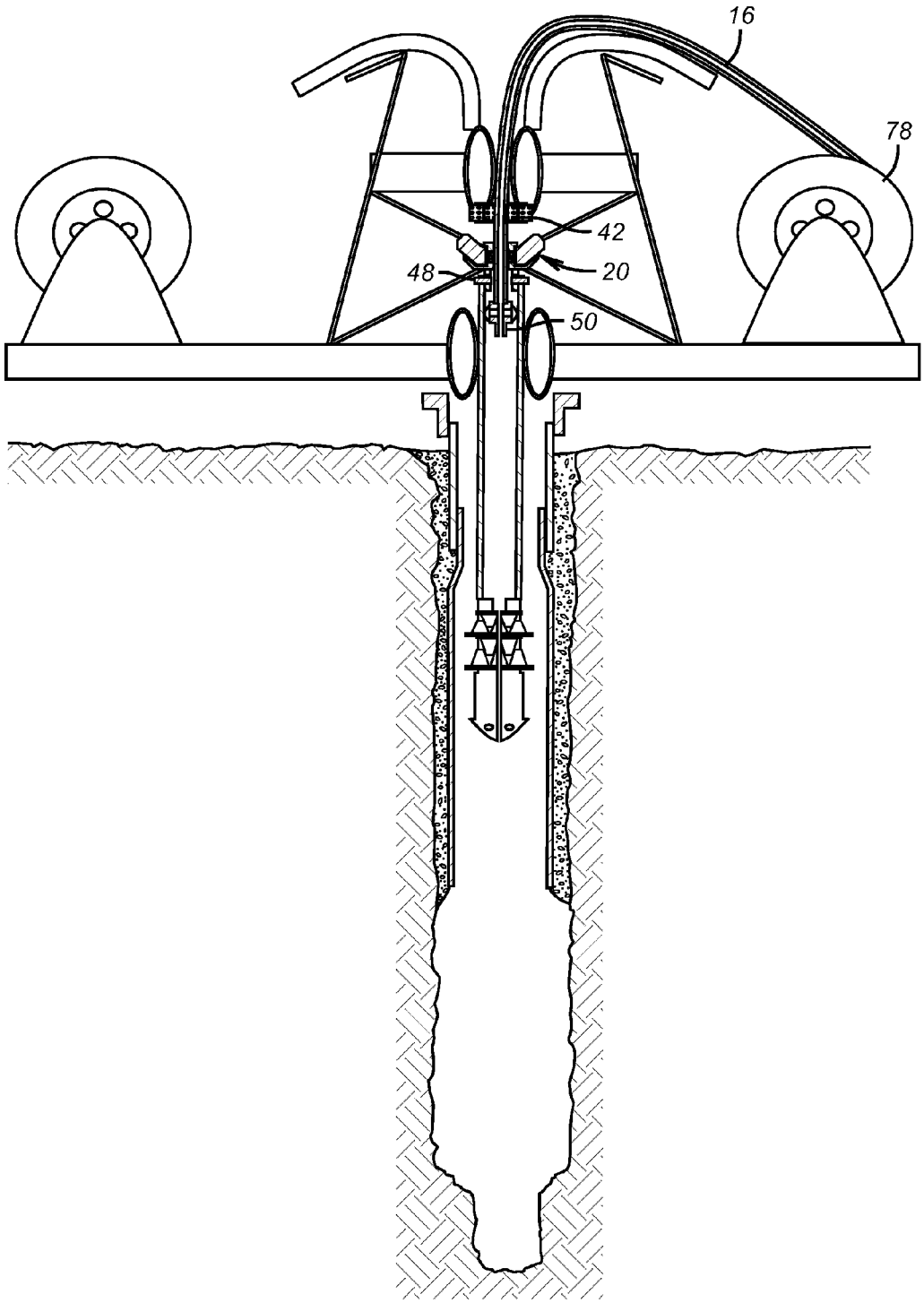
FIG. 10 shows the running string run into the injector assembly.

In FIG. 10 the anchor 42 is affixed to the running string 16 as is the seal assembly 20 with the connector tool 50 then being attached to the string 16. The string 16 can be a coiled tubing string fed off spool 78. The packer cup assembly 20 is attached to the already dressed upper end of the string 18 using the breakable connection 48. Anchor 42 at this point is still loosely fit to the string 16.

Figure 11:
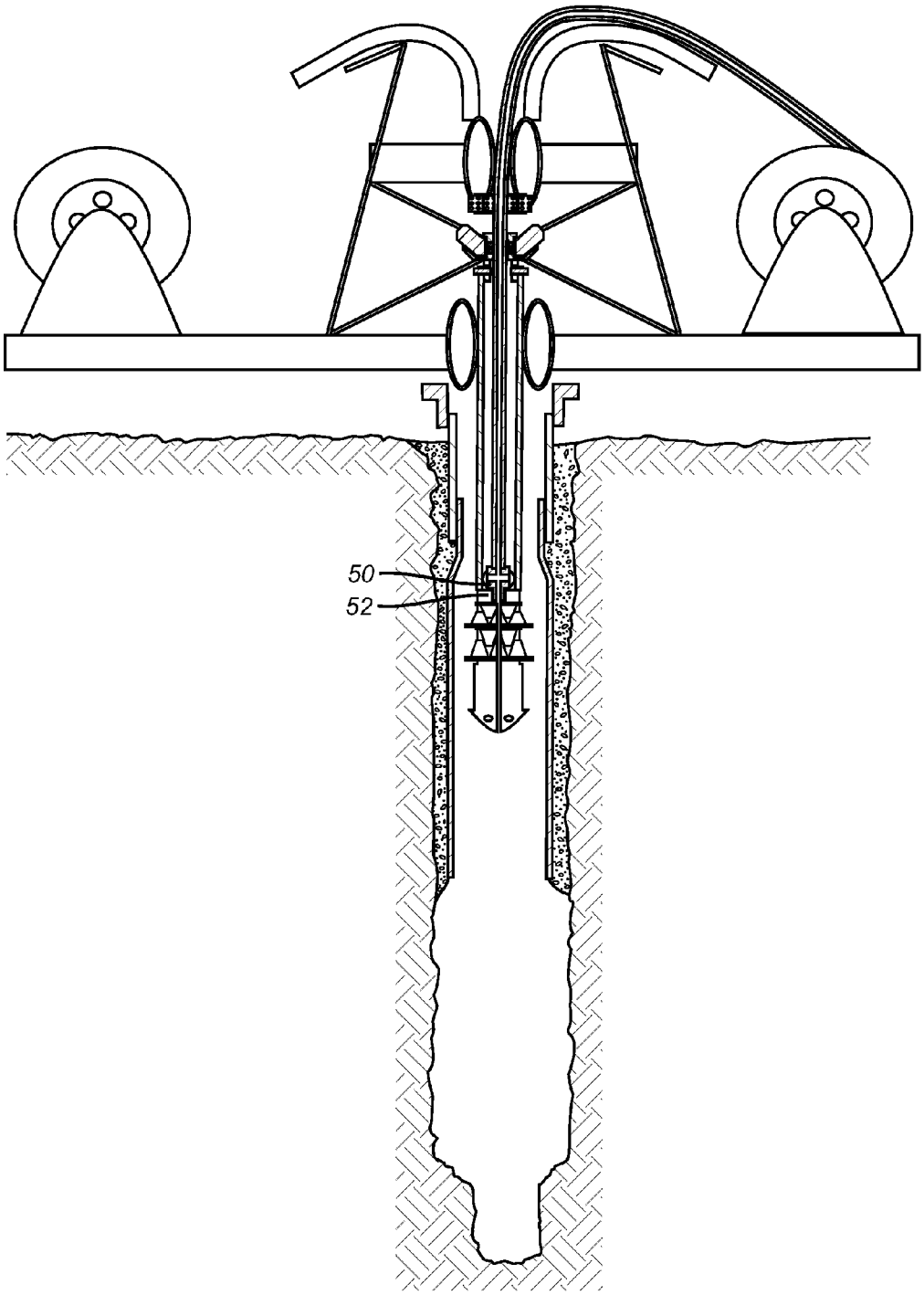
FIG. 11 shows the running string tagged into the swage assembly.

In FIG. 11 the string 16 is advanced until the connector tool 50 latches into receptacle 52 so that the string 16 can take on the weight of the liner 18. The running string 16 is picked up to insure it is supporting the liner 18 and if it is then the anchor 42 is attached to the liner 18.

Figure 12:
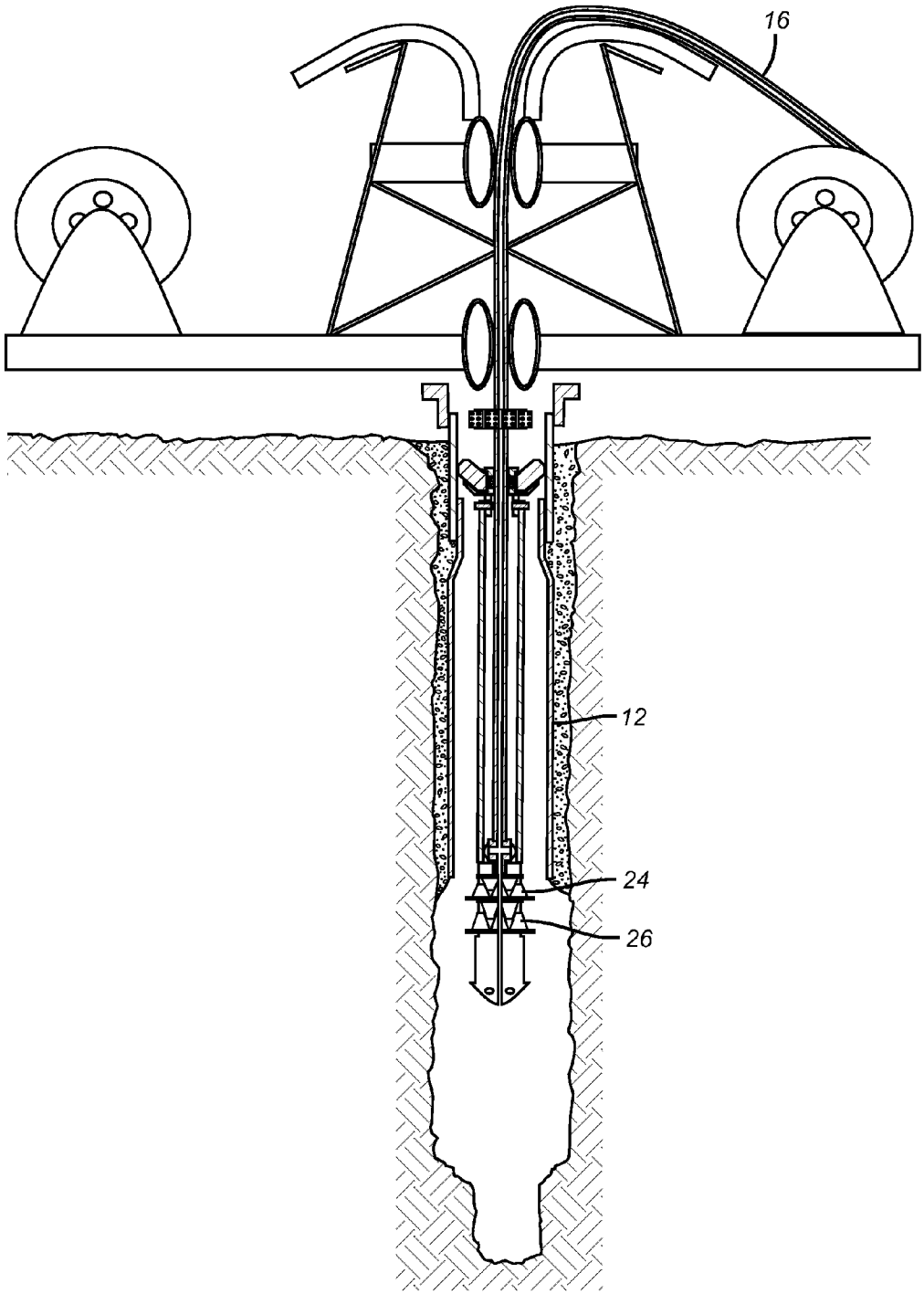
FIG. 12 shows the string to be expanded positioned so that the swage assembly is below the lower end of the existing string.
Figure 13:
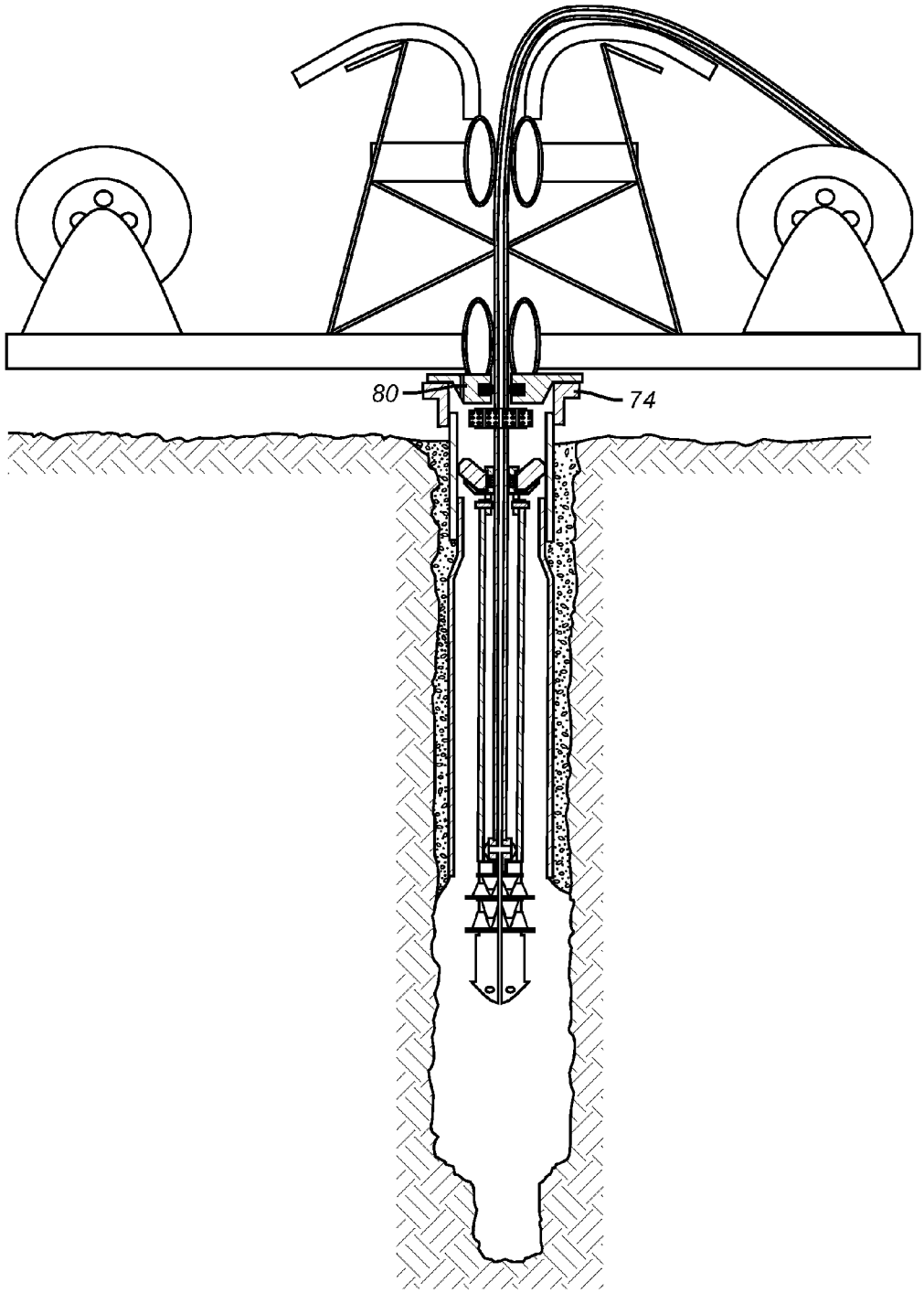
FIG. 13 shows the installation of a top seal that will later permit pressurizing the annulus.
Figure 14:
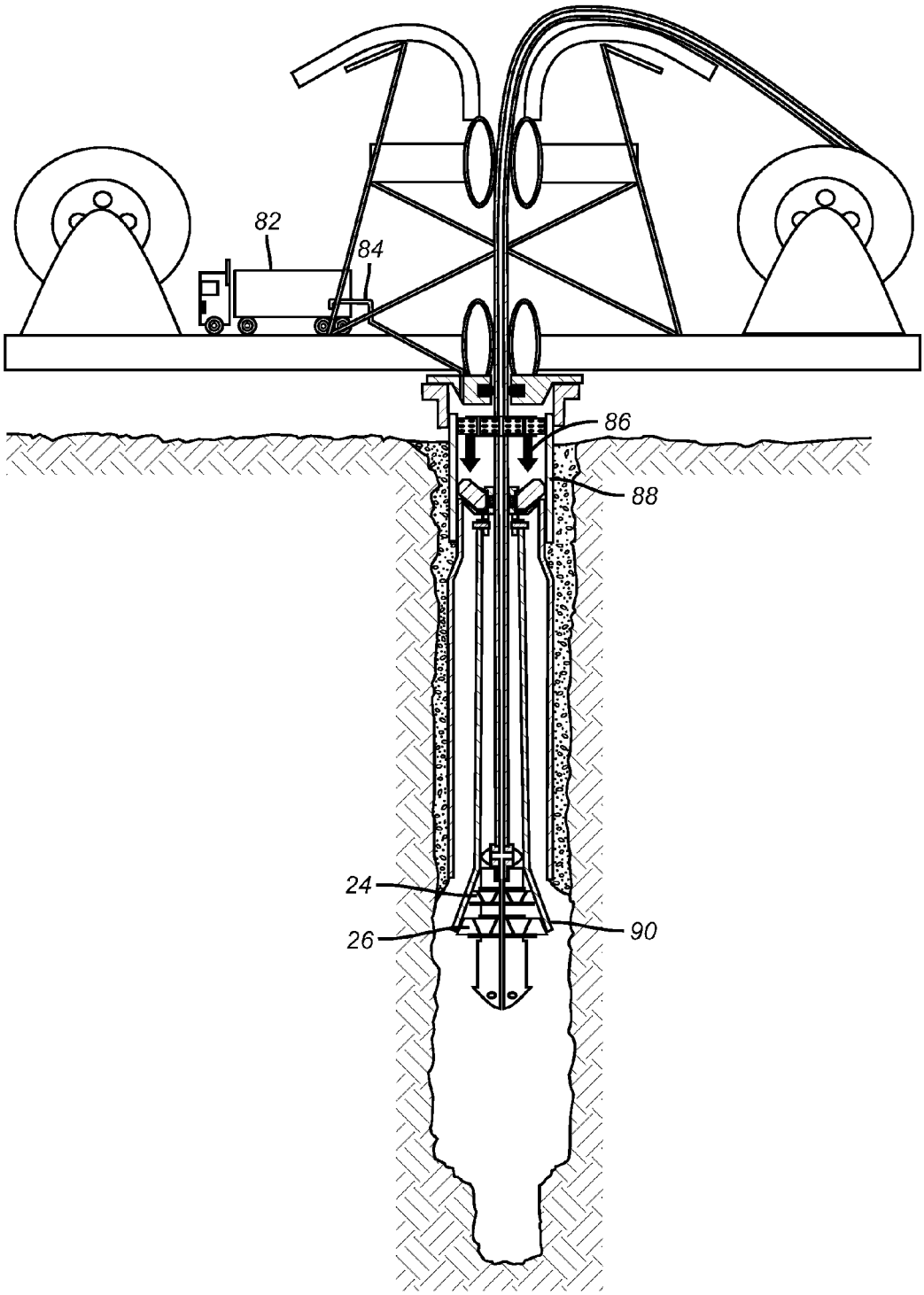
FIG. 14 shows pressure applied in the annulus above a seal to drive the string to be expanded over the swage assembly while the running string is anchored to an existing string.

In FIG. 12 the swages 24 and 26 are lowered with the string 16 to below the lower end of the existing string 12. In FIG. 13 a stuffing box 80 is secured at flange 74. In FIG. 14 a pump truck 82 is connected with a line 84 to below the stuffing box 80 to result in a downward force represented by arrow 86 against the seal 20. Before such pressure is applied however, the anchor 42 is set against the parent casing 88 so that the rig 64 is not stressed from the expansion operation that results from pressure advancing string 18 over the now deployed swages 24 and 26 that remain stationary because they are now supported by anchor 42. The anchor 42 can be made responsive to deploy upon delivery of pressure represented by arrow 86 or alternatively by mechanical tension of running string 16. Higher pressure than needed to set the anchor 42 then shears the connection between the liner 18 and the swages 24 and 26 as the liner 18 starts moving. The initial liner 18 movement builds the swages 24 and 26 to their full dimension with swage 26 being larger than swage 24. A bell 90 forms at the lower end of string 18 as pressure on seal 20 advances string 18 over fully built swages 24 and 26.

Figure 15:
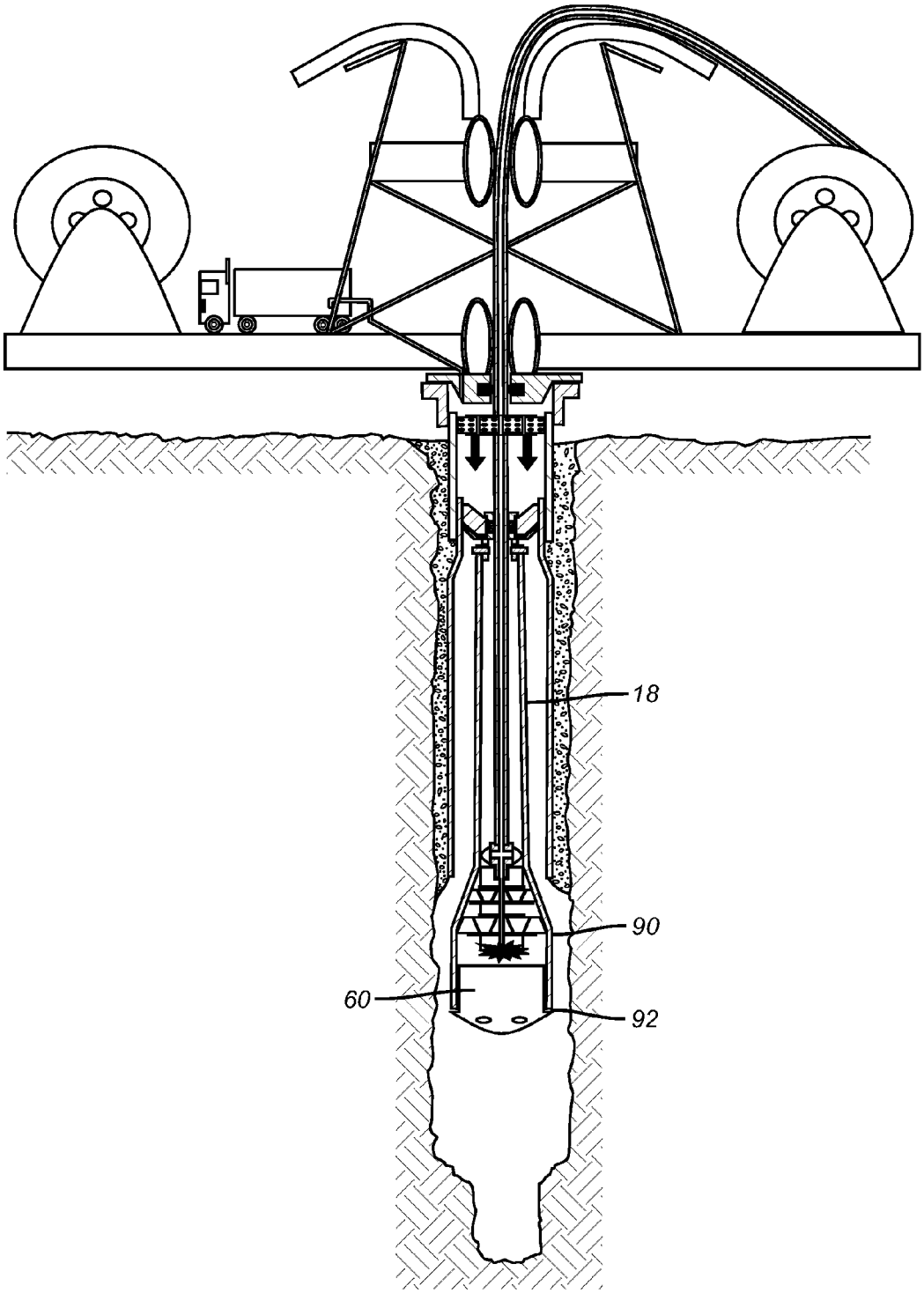
FIG. 15 shows engaging the cementing shoe to the already expanded lower end of the string being expanded.
Figure 16:
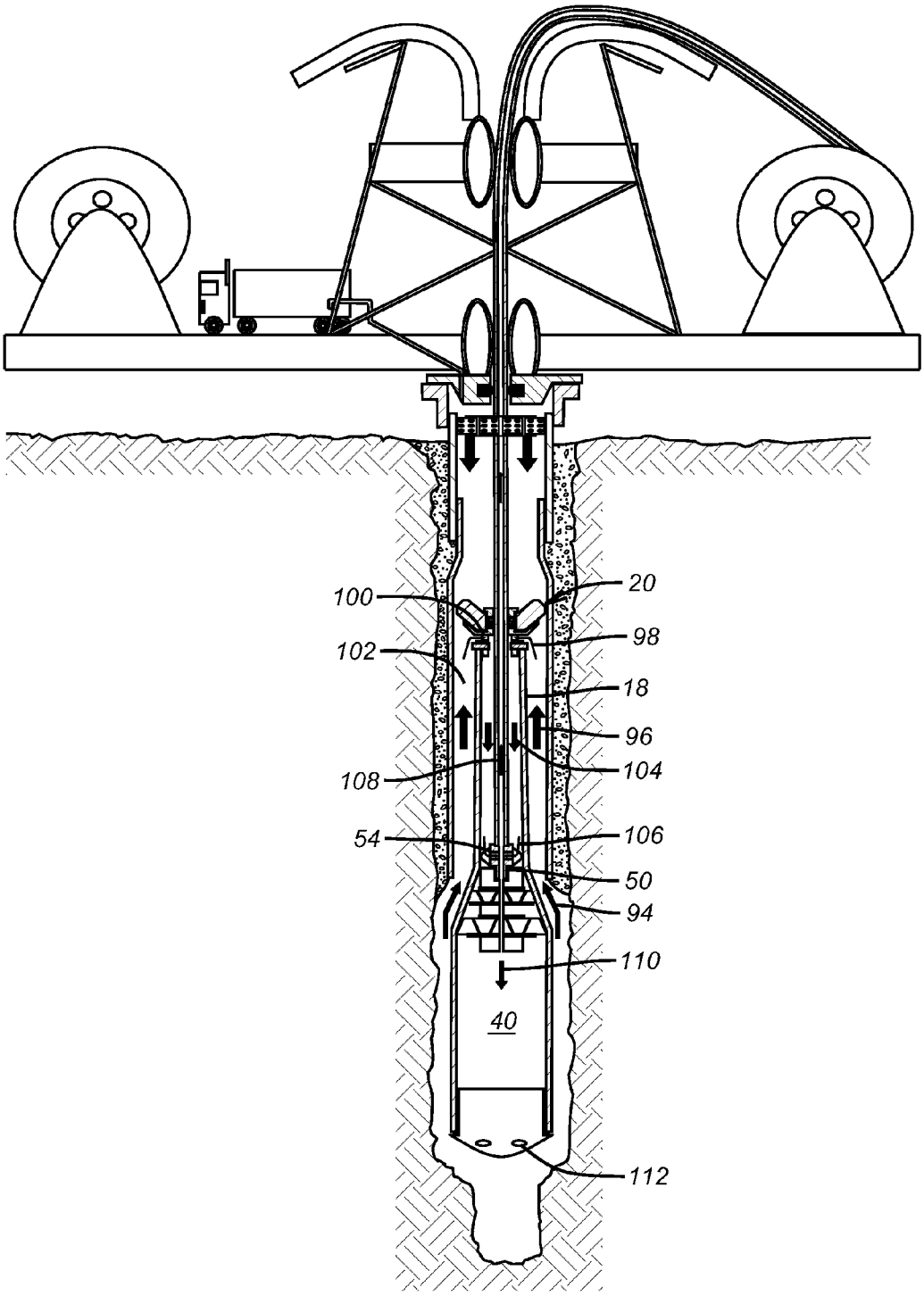
FIG. 16 shows continuation of expansion and the movement of displaced fluid during such expansion.

In FIG. 15 the shoe 60 releases from swages 24 and 26 and deploys sealingly against the now expanded bell 90 at the lower end of the string 18. A seal and slip assembly is schematically illustrated at 92 to show the shoe 60 secured to the string 18 for subsequent cementing. FIG. 16 shows the liner 18 continuing to advance and displace fluid as it does so. The displaced fluid is represented by arrows 94, 96 and 98 that then enter ports 100 in the seal assembly 20. From there the flow continues into annulus 102 as indicated by arrows 104 and 106 and into ports 54 of connector 50. From there the flow can go into space 40 whose volume grows as the liner 18 moves downhole, as illustrated by arrow 110 or uphole through the liner 18 as illustrated by the arrow 108. As an alternative to the above flow scheme the cement shoe 60 can have its ports 112 held open to take returns into space 40 and when the initial expansion is done the check valves (not shown) in the shoe 60 can be enabled to stop flow into space 40 when the cementing later takes place.

Figure 17:
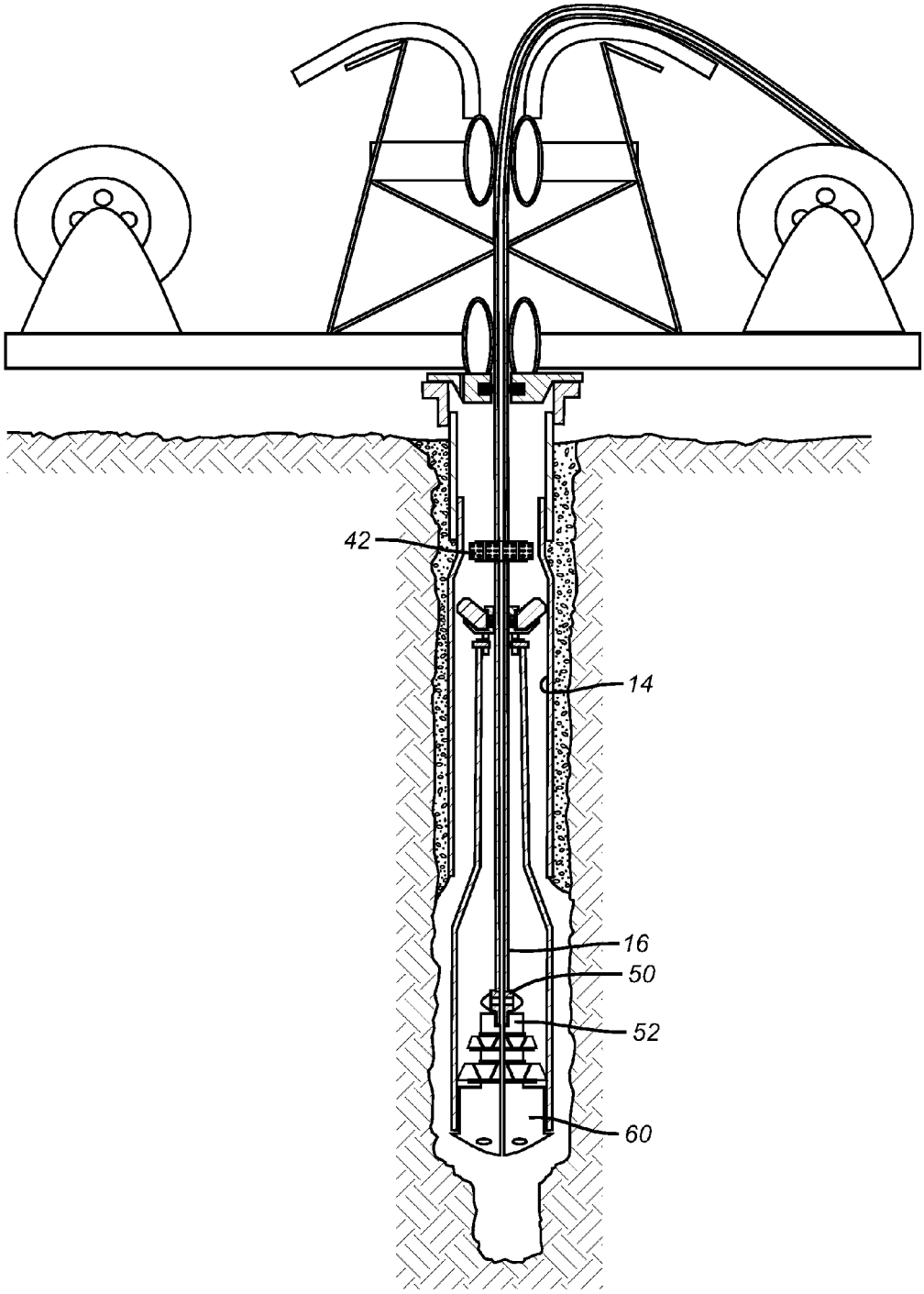
FIG. 17 shows release of the running string anchor and stabbing the expansion assembly into the cement shoe.

The expansion stops in FIG. 17 just short of the recess 14 and the removal of pressure unsets the anchor 42. The work string 16 is advanced to tag the swage assembly into the cement shoe. The connection to receptacle 52 can be confirmed with a pickup force to run in string 16. At this time the string 16 is latched through to the cement shoe 60 and cementing can begin.

Figure 18:
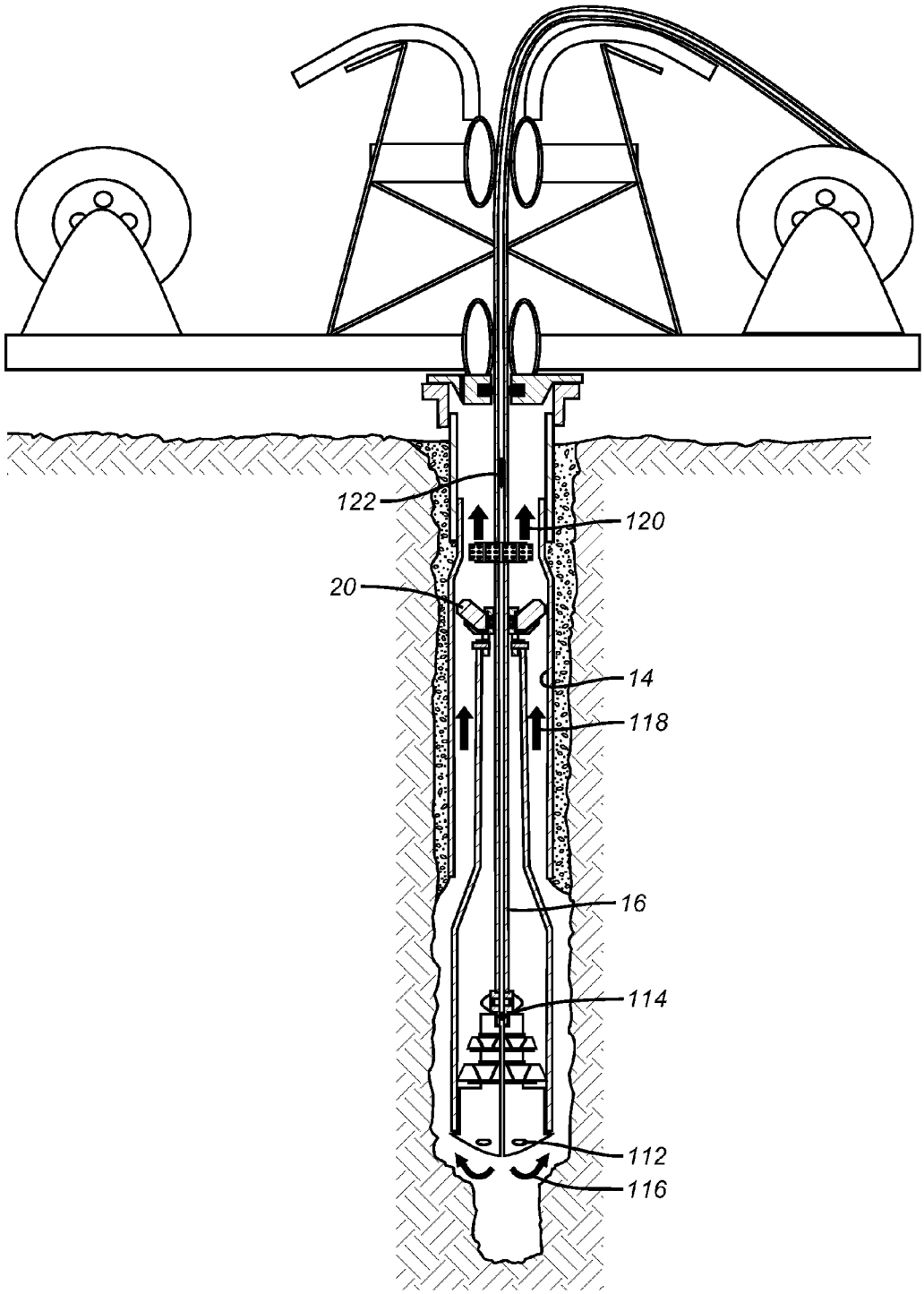
FIG. 18 shows pumping cement and the movement of displaced fluid from cementing.
Figure 19:
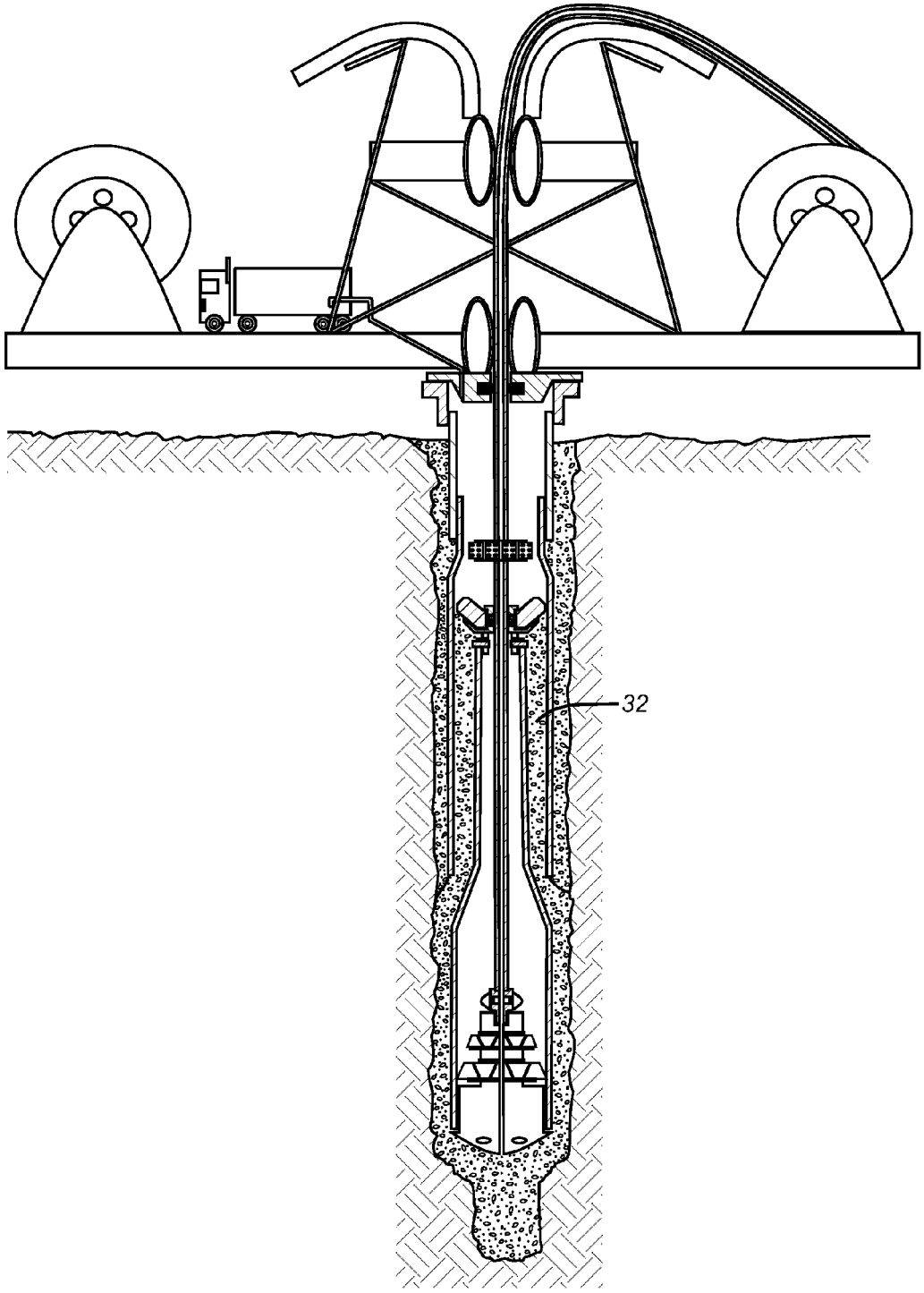
FIG. 19 shows the cementing job finished.
Figure 20:
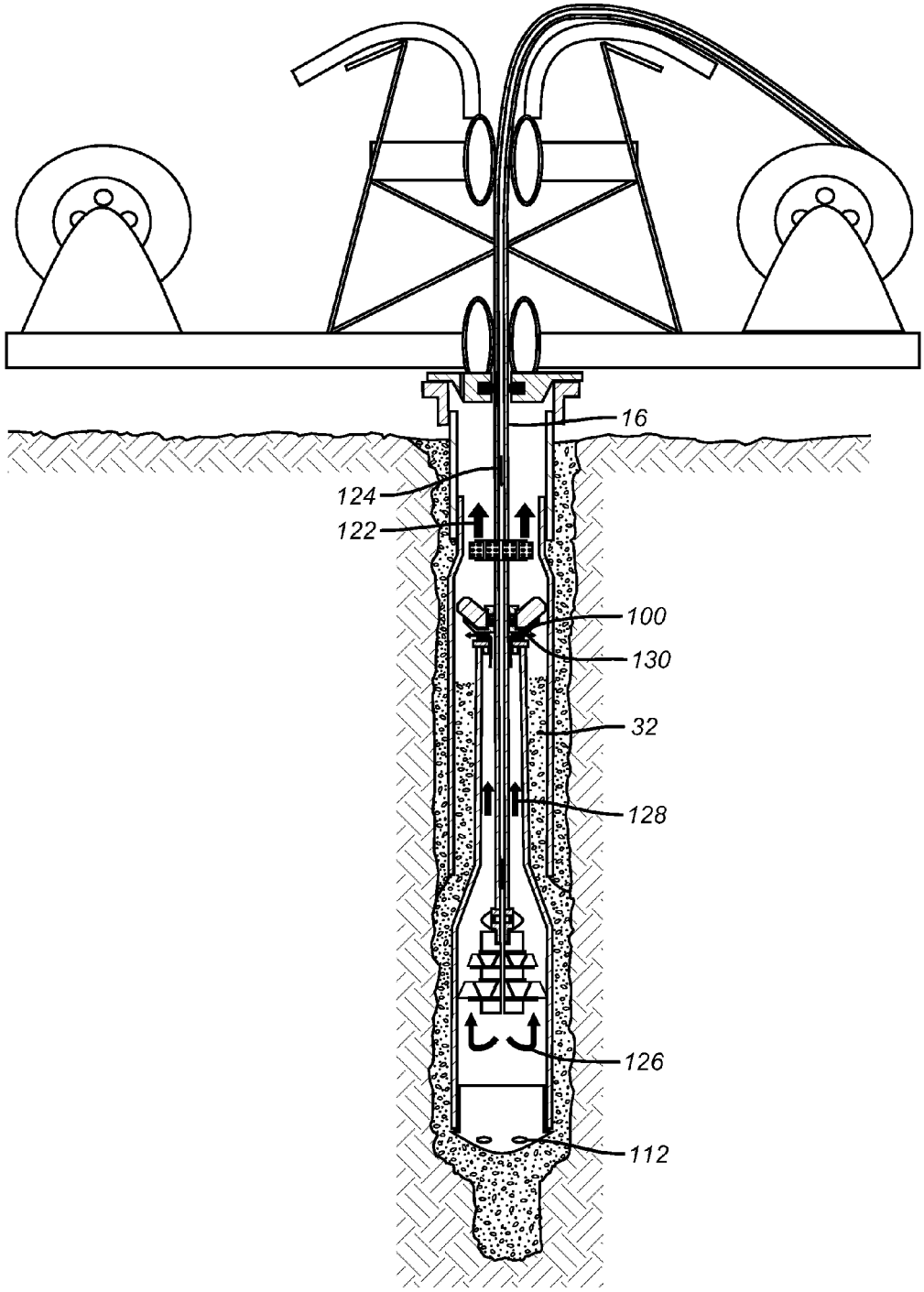
FIG. 20 shows circulating out the excess cement.

In FIG. 18 a lead plug 114 has been dropped ahead of the cement being added to close off ports 54 that schematically are no longer shown in the connector 50. The plug 114 has a passage through it temporarily blocked by a rupture disc (not shown) so that the delivered cement goes straight through the connector 50 and out the ports 112 as indicated by arrows 116. At this time the seal assembly 20 is out of contact with the recess 14 so that fluids displaced by the flowing cement go uphole and past the unset anchor 42 as indicated by arrows 118 and 120. Arrow 122 represents cement delivery through the string 16. FIG. 19 shows the cement delivered to fill the gap 32 and the plug behind the cement (not shown) bumped against the lead plug 114 (not shown in this view). The cement pumps can be turned off at this time. FIG. 20 shows the shoe 60 released by the swages 24 and 26 which has the effect of closing ports 112 in opposed directions to flow. Circulation flow represented by arrow 124 down the string 16 removes excess cement that then travels through the end of the string 16 represented by arrows 126, 128 and 130 through ports 100 and up to the surface as represented by arrows 132. This circulation can be repeated as expansion is resumed to remove further displaced cement out of gap 32 as gap 32 is closed by continuing expansion.

Figure 21:
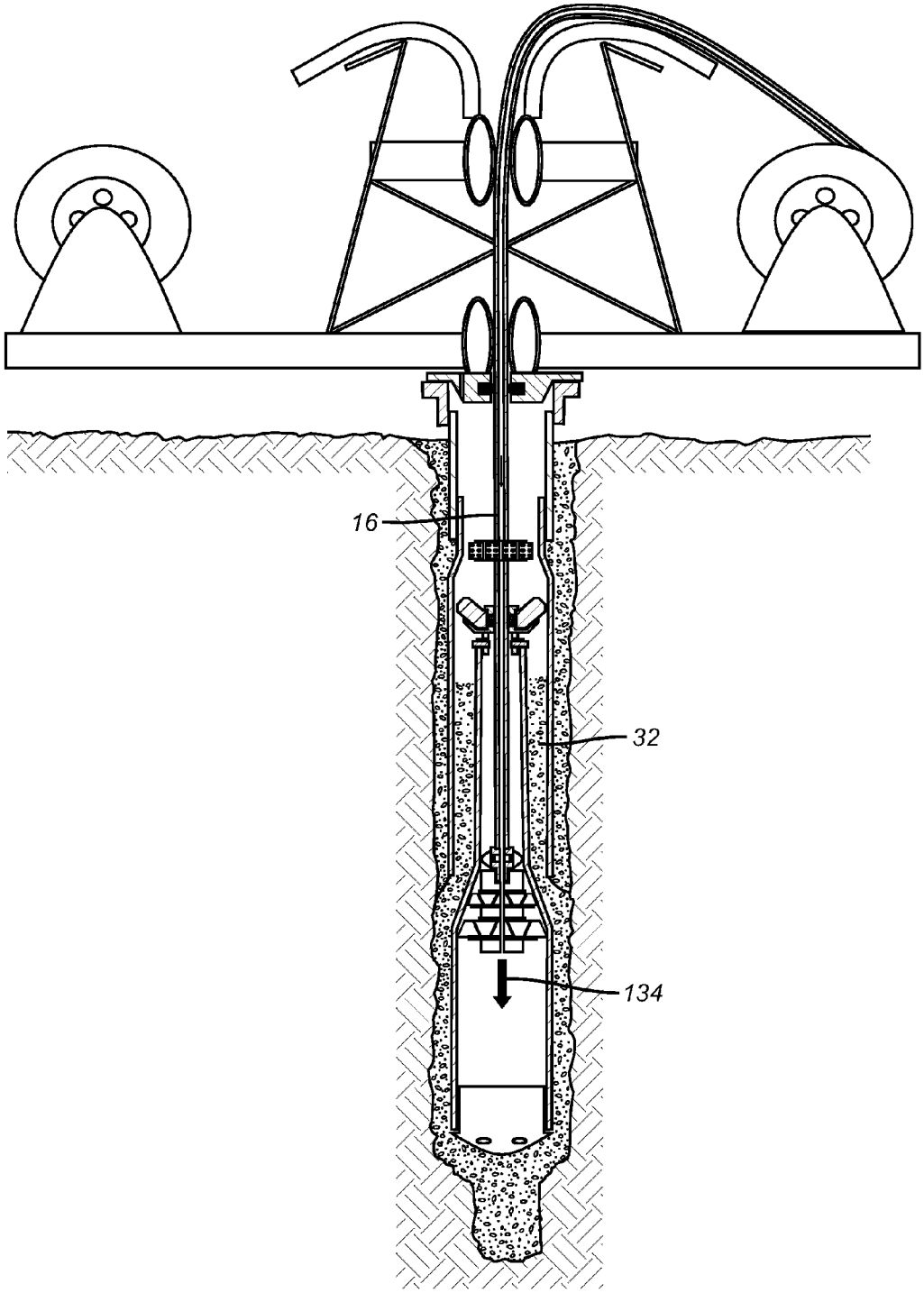
FIG. 21 shows releasing the expansion assembly from the shoe and raising the expansion assembly to a position where expansion can continue.
Figure 22:
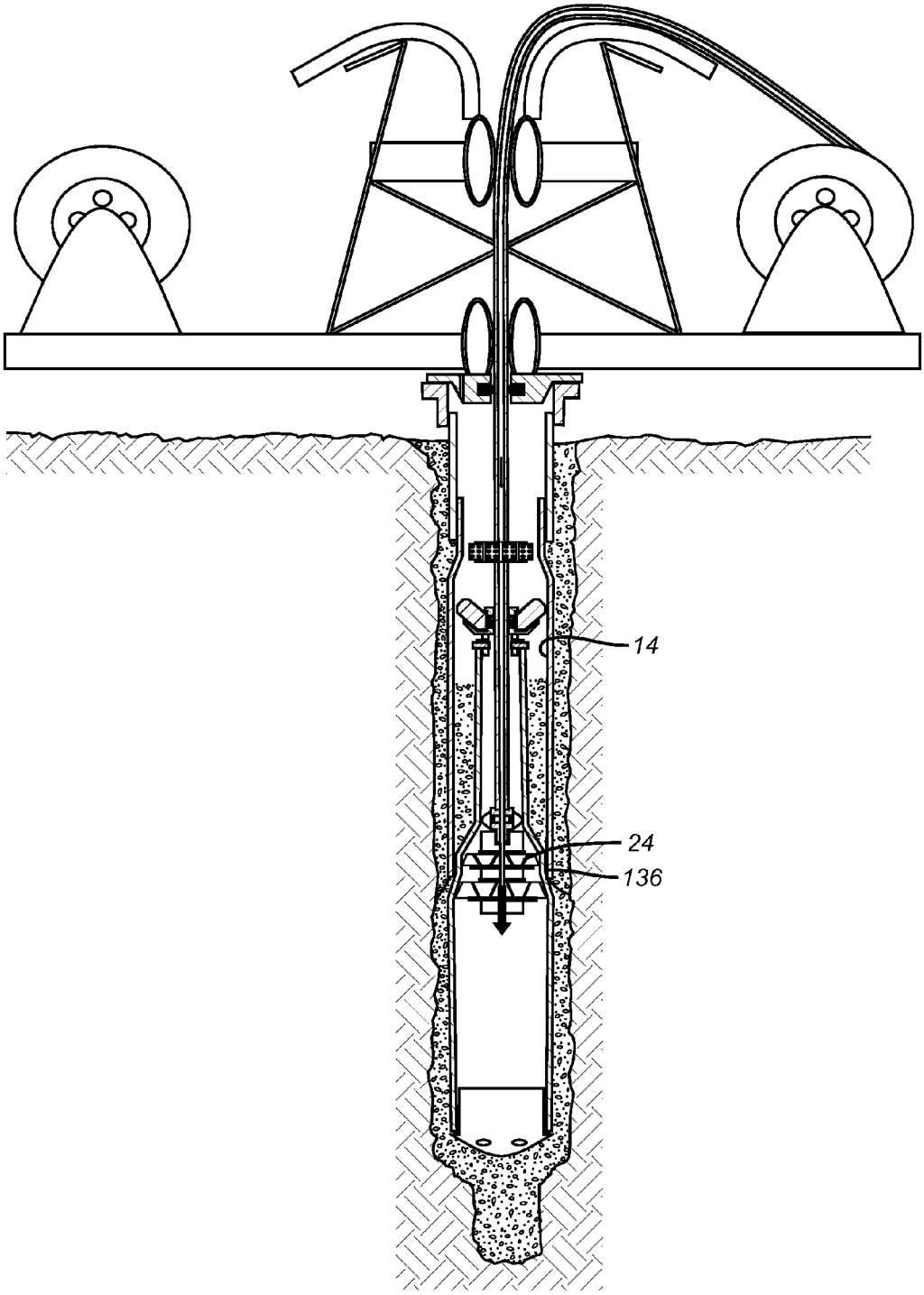
FIG. 22 shows contacting the recess in the existing string with the top of the string being expanded.

In FIG. 21 the string 16 is picked up to engage swage 24 that is now built and close off the ability for flow to bypass the swages 24 and 26. The swage can seal metal to metal upon expansion contact or there can be a sealing tool independent of the swages above or below the swages that allows for pressure buildup behind the swages 24 and 26 as represented by arrows 134. While initial overpull helps to obtain the seal, thereafter pressure applied as indicated by arrows 134 helps to maintain the seal so that the swage 24 can be powered up to continue expansion of the liner 18 to close the gap 32 by displacing cement out of it. In FIG. 22 the smaller swage is in the recess 14 and the larger swage 26 is just below recess 14. The lap 136 is now anchored and sealed.

Figure 23:
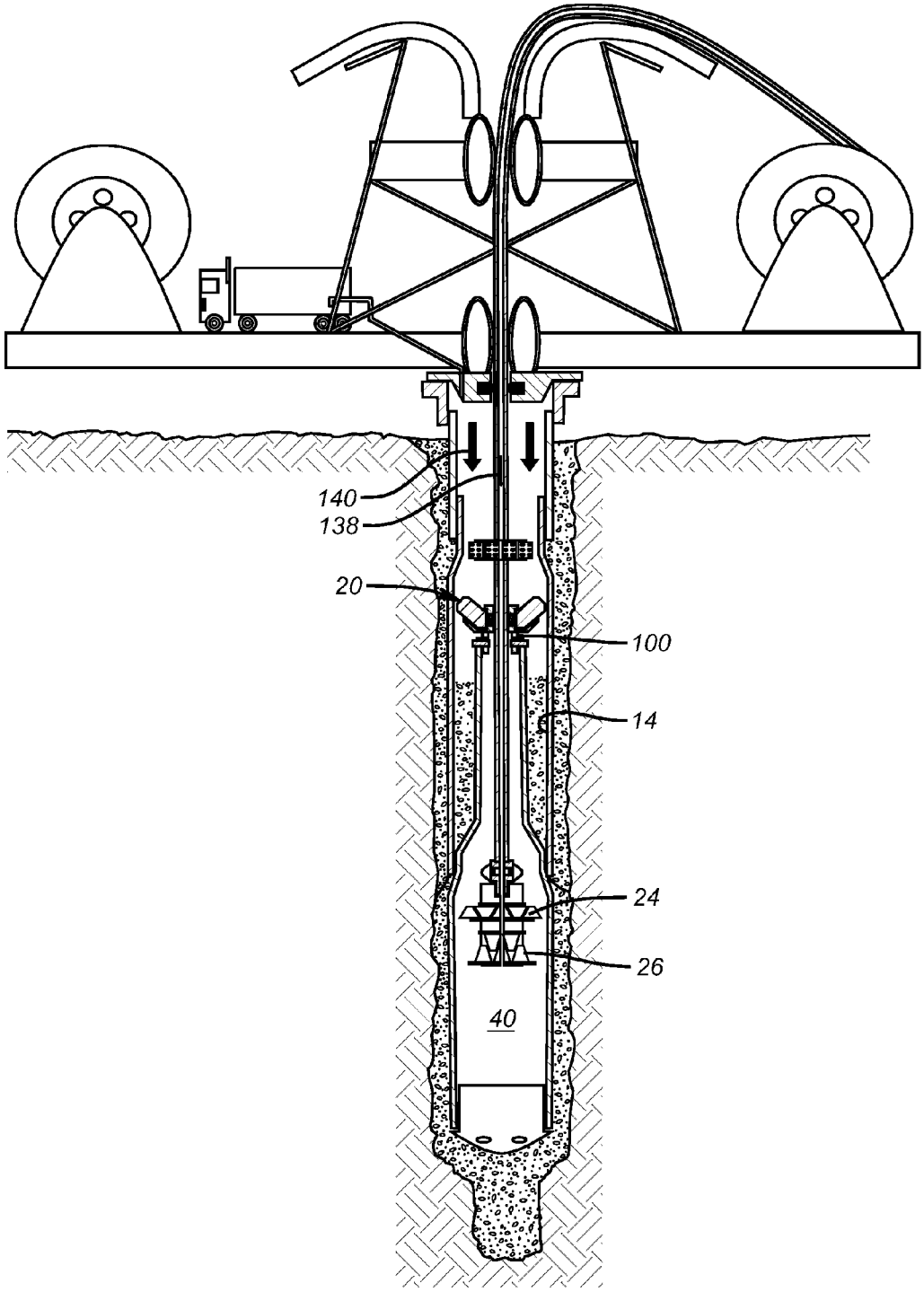
FIG. 23 shows lowering the expansion assembly so that the larger swage can be collapsed.

In FIG. 23 the string 11 is lowered and pressure is applied in the string 16 as indicated by arrow 138 and in the annulus as indicated by arrow 140 at the same time. The net result is that the larger swage 26 is collapsed while swage 24 continues to be in the built condition for further expansion. The annulus pressure represented by arrow 140 goes through ports 100 and into space 40. There is no flow past seal 20 because of the balanced pressure applied in the string 16.

Figure 24:
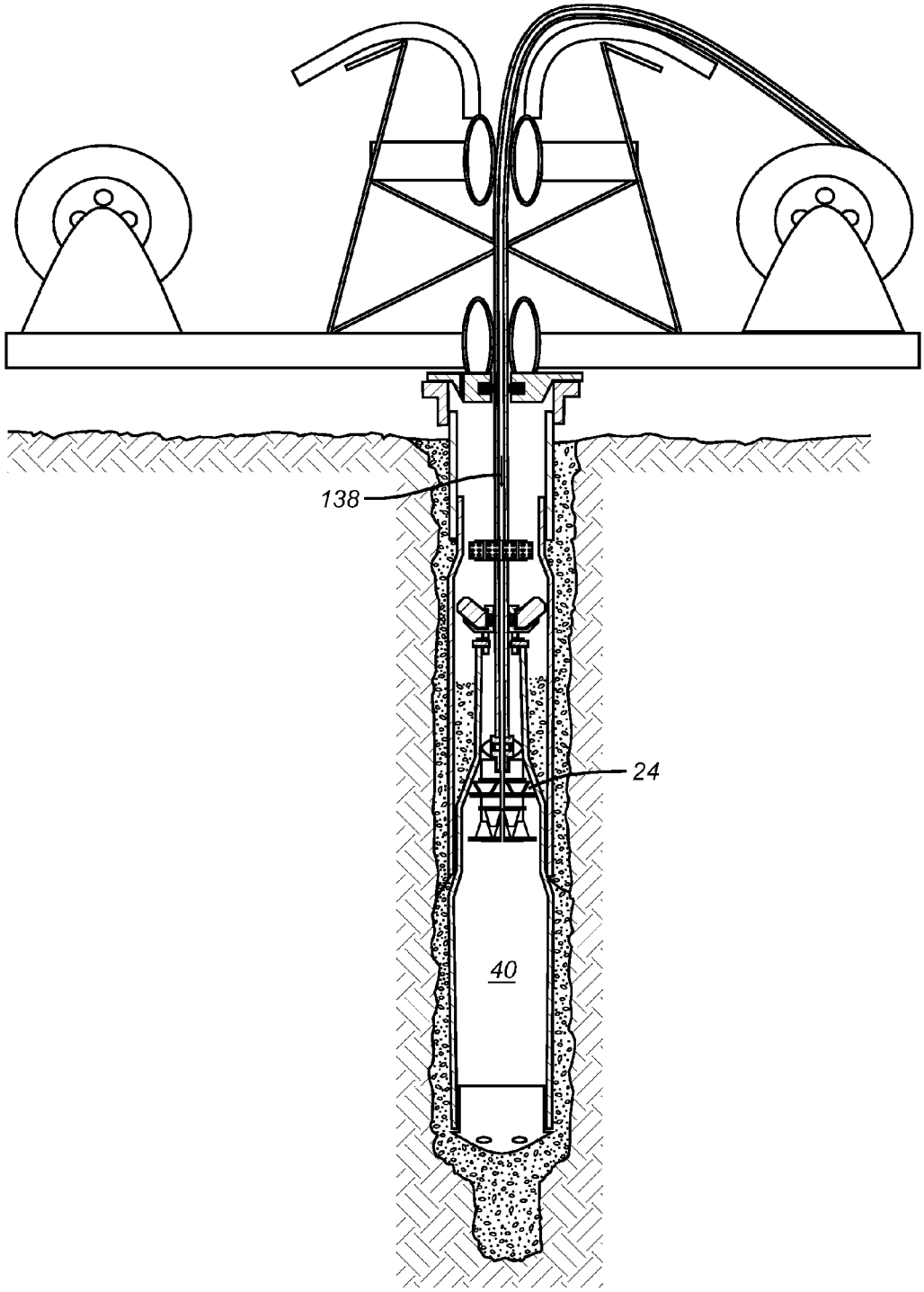
FIG. 24 shows concluding the expansion with the smaller swage while the larger swage is collapsed.
Figure 25:
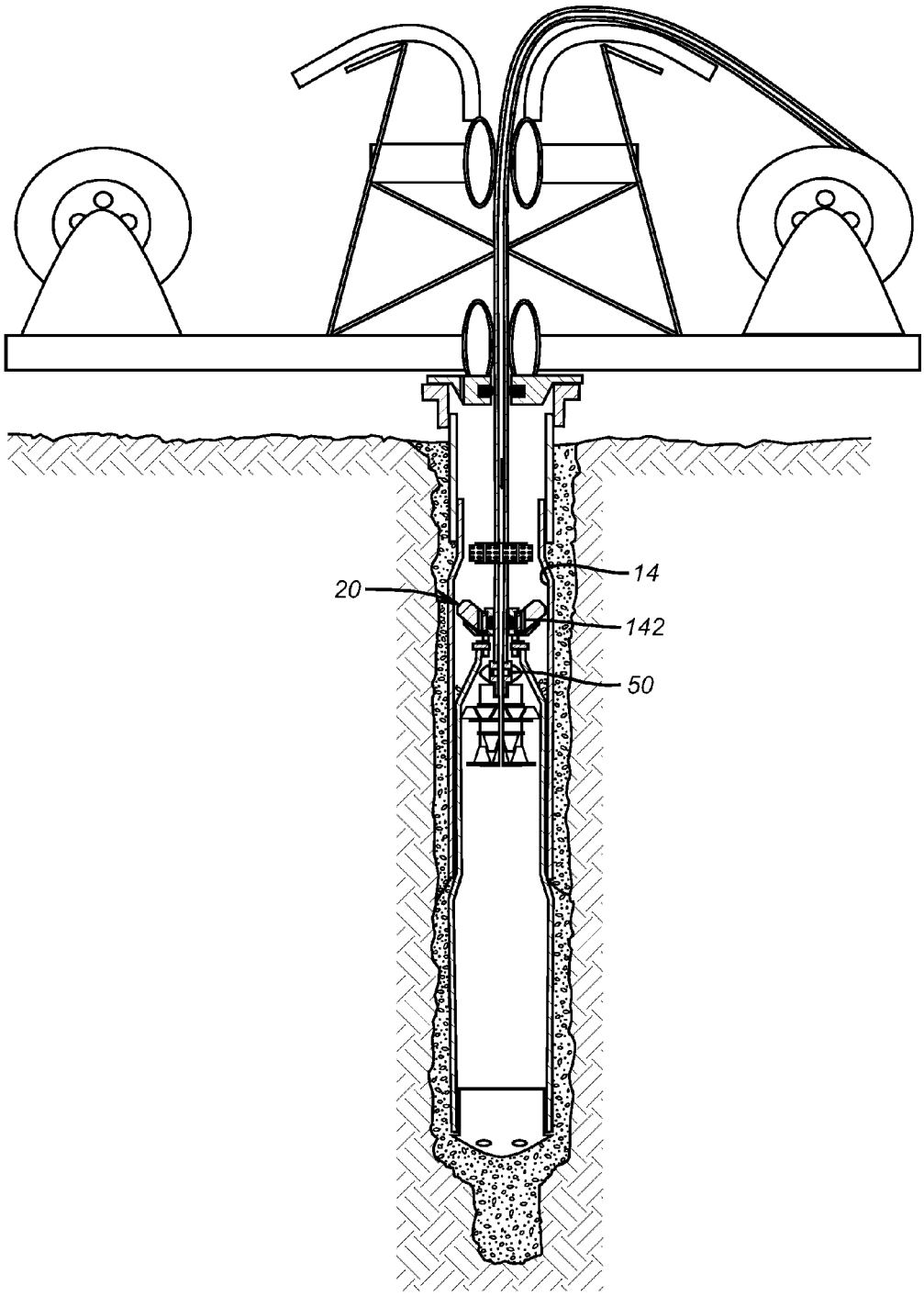
FIG. 25 shows a bypass opened in the cup seal as the balance of the expansion concludes with the swage assembly engaging into the cup seal assembly.

In FIG. 24 the swage 24 is raised to sealing contact with the liner 18 and pressure is only applied in the string 16 represented by arrow so that the liner lap is made longer as hanger seals and slips on the string 18 (not shown) are brought into contact with the recess 14. In FIG. 25 the expansion has continued until the connector 50 bumps the seal 20 so that they attach to each other and that opens the bypass for the seal 20 that is schematically illustrated as 142. The removal of the string 16 past the recess 14 will not allow for pulling a wet string or swabbing the well because the bypass openings 142 are open.

Figure 26:
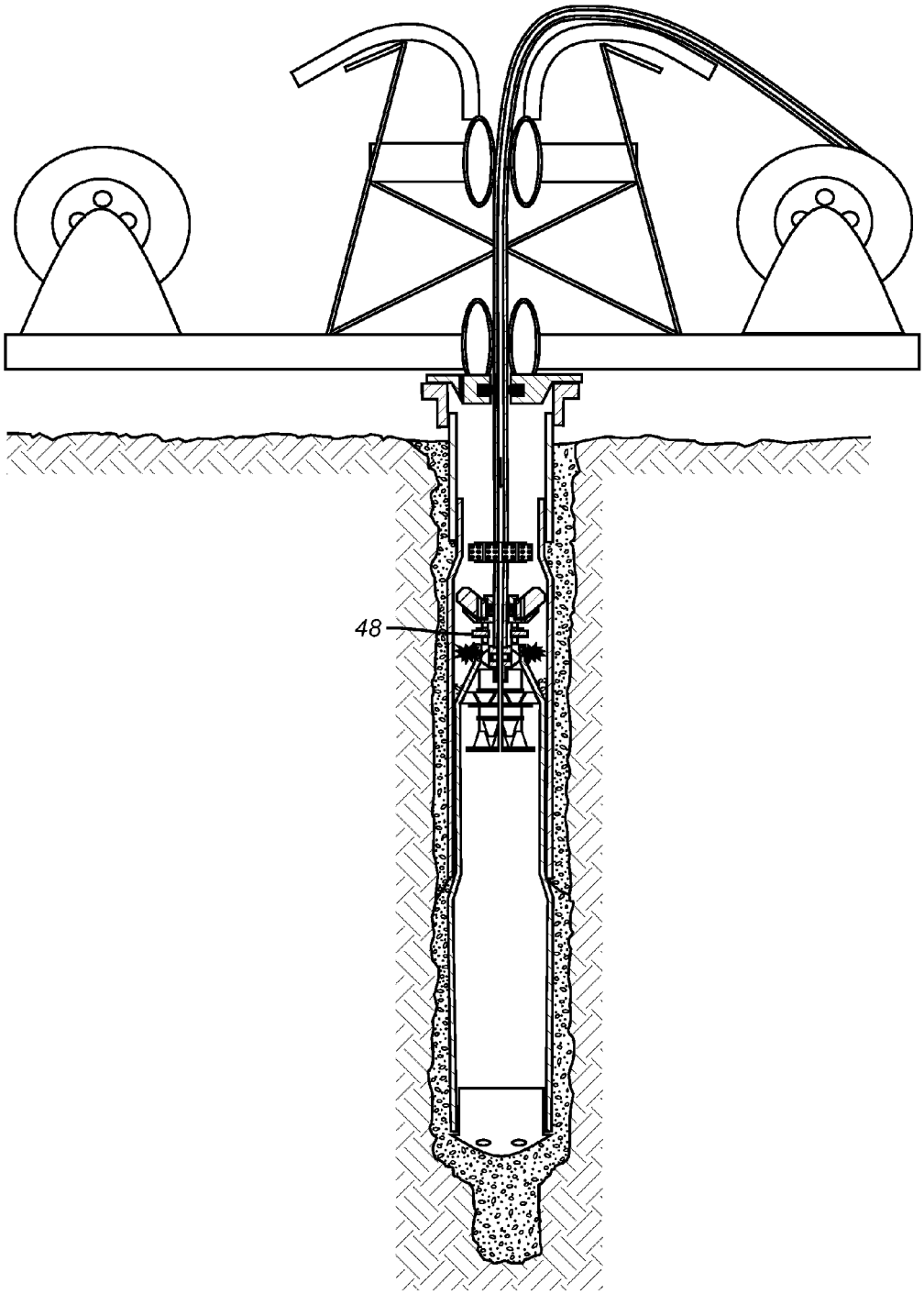
FIG. 26 shows the cup seal assembly released from the liner top being expanded.
Figure 27:
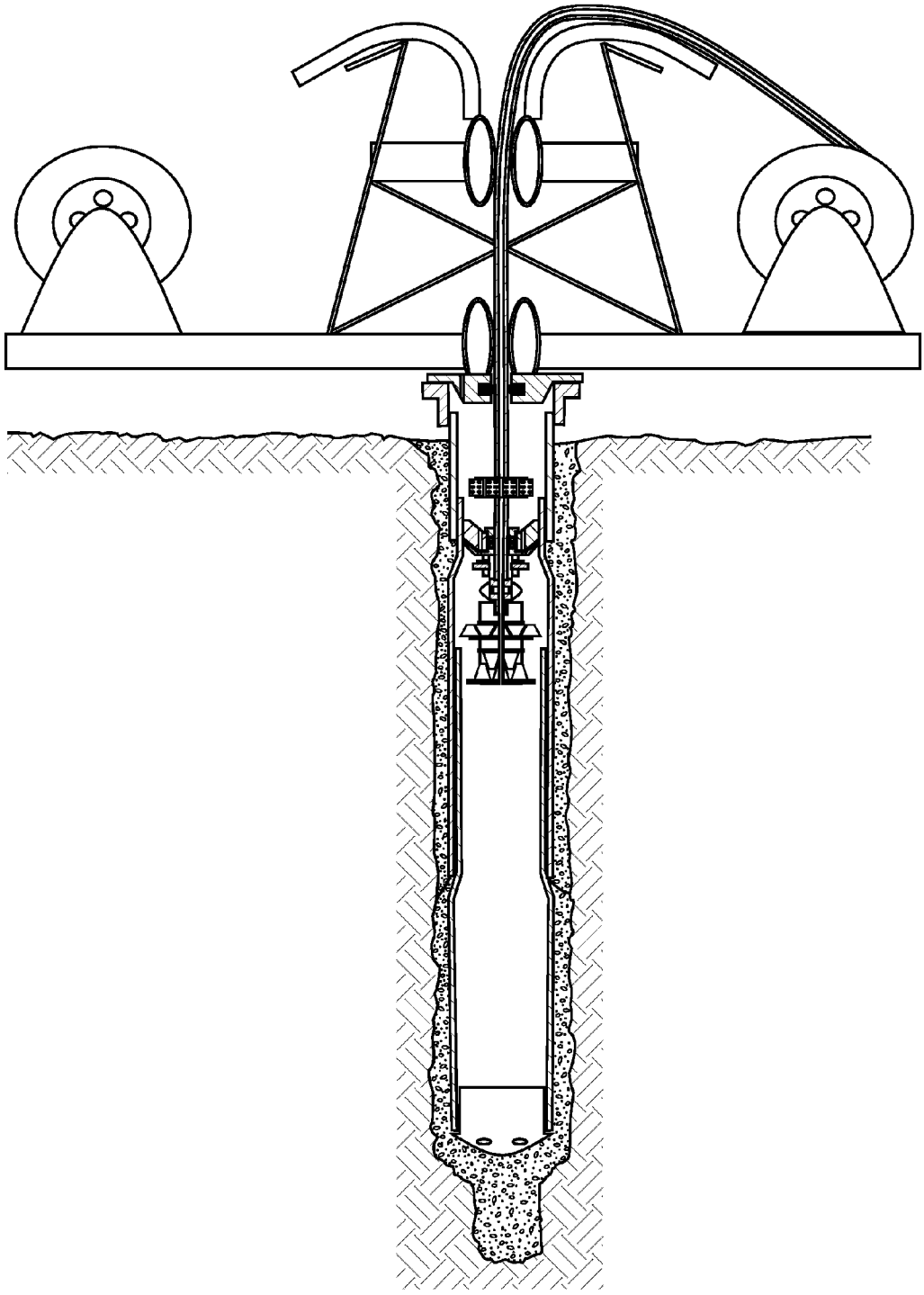
FIG. 27 shows the swage assembly coming out of the liner top.
Figure 28:
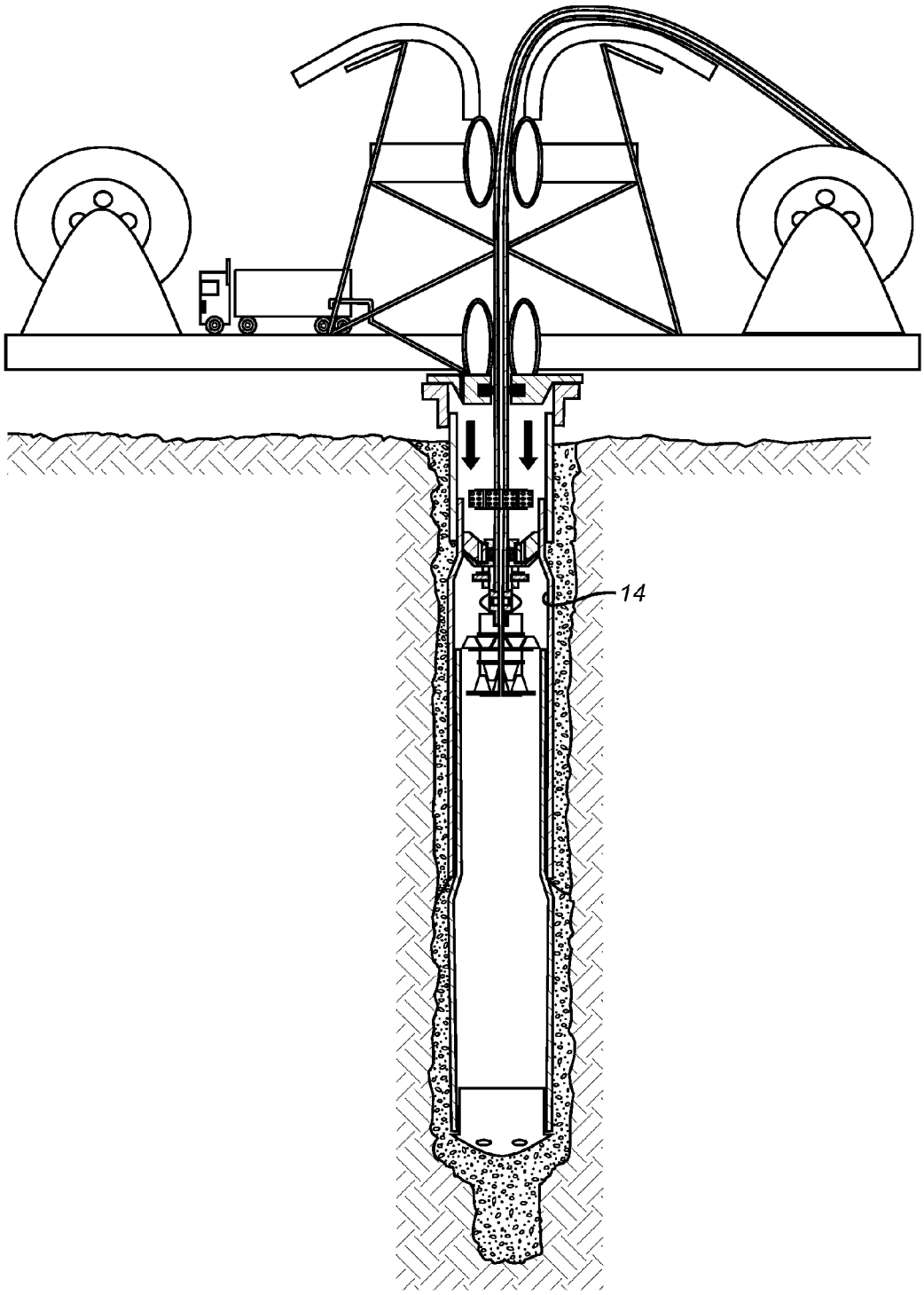
FIG. 28 shows a set down force to collapse the smaller of the swages.

Further movement of the string 16 in FIG. 26 breaks the connection 48 of the seal 20 to the liner 18. Continued pumping allows the swages 24 and 26 to exit the liner 18 at the top, as shown in FIG. 27 with the swage 24 still in the recess 14. A set down force as shown in FIG. 28 allows the swage 24 to collapse. The force can be from simply setting down weight or applying annulus pressure to create an impact force to collapse the swage 24.

Figure 29:
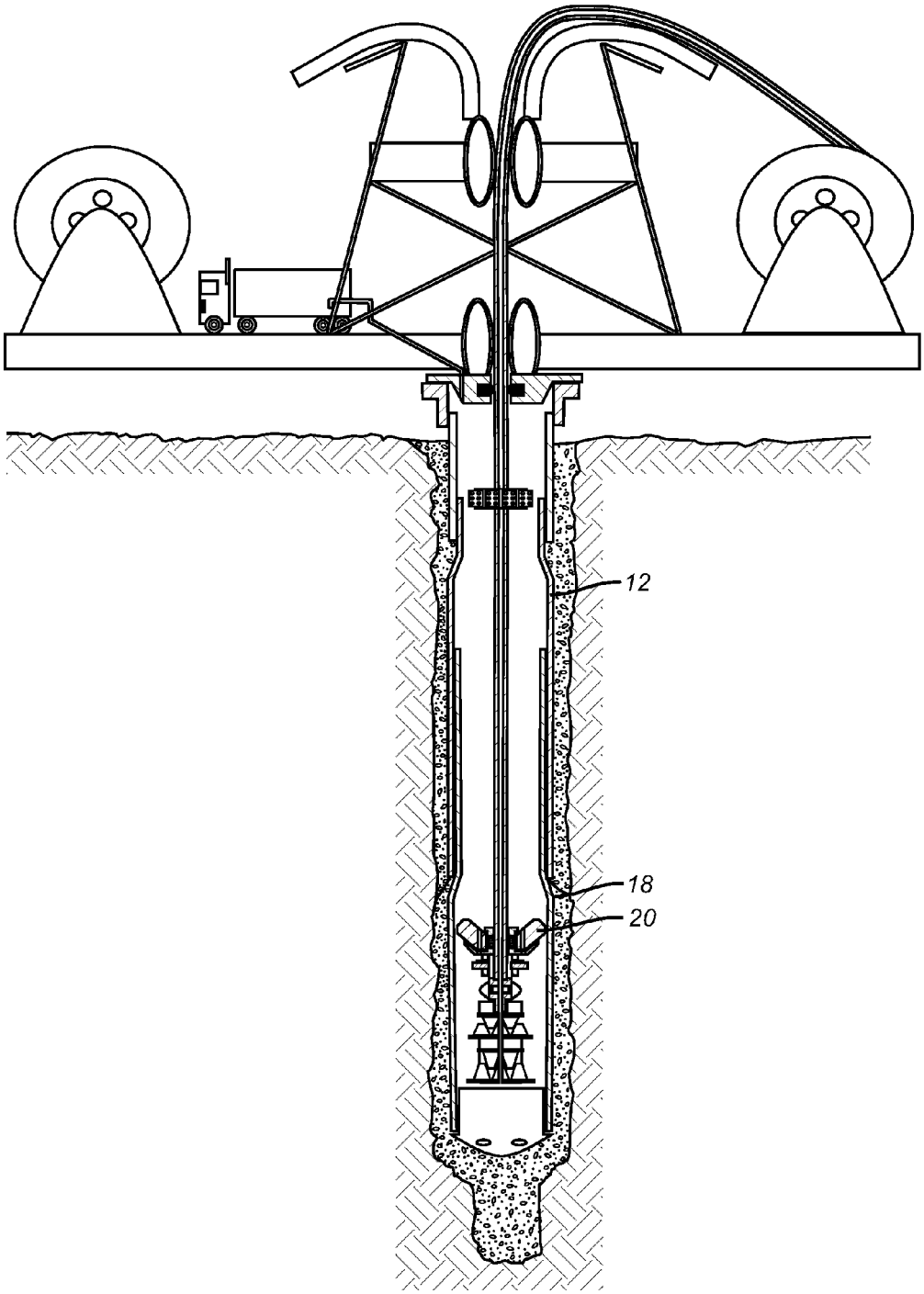
FIG. 29 shows movement down through the expanded string to confirm that it has the required drift dimension that allows the swage assembly to exit in a collapsed state.
Figure 30:
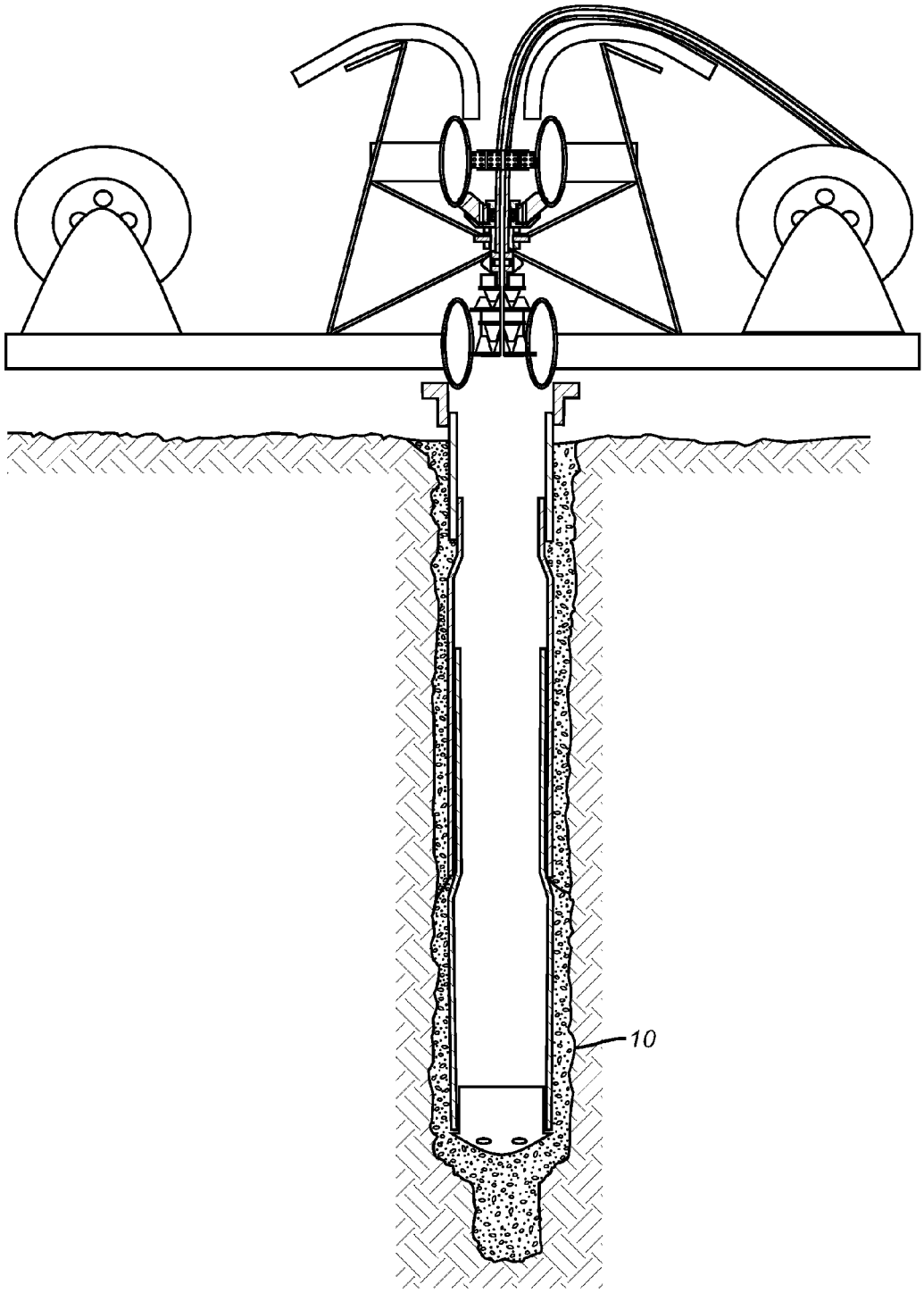
FIG. 30 shows the assembly removed and the resulting extension of the well as a monobore.

FIG. 29 shows an option trip downhole to check drift with the seal assembly 20. The movement of the seal assembly 20 can be aided with pressure for both uphole and downhole movement of the seal assembly 20. In the FIG. 29 position the borehole 10 can be pressured to test the integrity of the connection between the liner 18 and the existing tubular. FIG. 30 shows the string 16 and the equipment mounted to it removed from the well 10.

Those skilled in the art will appreciate that the method allows for completion of a well by adding a string and connecting it to an existing string involving an expansion that features advancing the string to be expanded over a swage assembly using pressure provided above a seal that moves with the string being expanded. The expansion takes place from the bottom up and employs variable swage devices that build to a first size for initial expansion and then to a smaller size inside a recess of the existing tubular so that the seal and swage assemblies can ultimately exit from the tubular being expanded and the existing tubular. In the preferred embodiment a monobore completion is achieved. The expansion is in stages with cementing taking place while a gap exists between the tubular being expanded and a lower end recess in the existing tubular. The seal assembly is bypassed in the recess of the existing tubular during cementing. A bypass opens in the seal assembly for ultimate removal to prevent pulling a wet string or swabbing the formation. The running string is anchored in the well against tension applied from forcing the tubular being expanded over a stationary swage assembly. The swage assembly uses two swages having different diameters that can both be deployed for the initial expansion and where a smaller of the two is deployed for connecting the top of the string being expanded to a lower end recess of an existing tubular. The string to be expanded can be jointed tubing or coiled tubing and its initial shape can be round or folded, such as in a generally figure eight shape, for example. The figure eight shape can use two running strings deployed in the wide portions of the folded string so that the act of driving the string over the swage assembly will not put harmful moments on the tubular that is being unfolded and expanded as it is driven past the swage assembly.

The above description is illustrative of the preferred embodiment and many modifications may be made by those skilled in the art without departing from the invention whose scope is to be determined from the literal and equivalent scope of the claims below.

We claim:

1. A well completion method, comprising:
supporting a swage assembly on a running string;
moving at least part of the time a first string to be expanded with respect to said swage assembly to expand said first string;
mounting a seal to said first string to seal to said running string and to a surrounding tubular;
defining a zone above said seal that, when pressurized, drives said first string over said swage assembly.

2. The method of claim 1, comprising:
keeping the swage assembly stationary during at least a portion of the expanding of said first string.

3. The method of claim 2, comprising:
anchoring said running string in said zone to an existing tubular before initially expanding said first string.

4. The method of claim 3, comprising:
using pressure in said zone or mechanical running string tension to accomplish said anchoring and to build said swage assembly for expansion of said first string.

5. The method of claim 3, comprising:
opening a bypass in said seal after expansion of said first string is complete.

6. The method of claim 1, comprising:
providing a cementing shoe initially supported by said swage assembly;
releasing said cementing shoe from said swage assembly by the onset of expansion of said first string;
sealingly securing said cement shoe to said first string after release from said swage assembly.

7. The method of claim 3, comprising:
creating a second zone between said swage assembly and a shoe, said second zone volume increases as said first string is pushed by pressure applied in said first zone;
directing displaced fluid from expansion of said first string into an annular space between said running string and said first string through an opening in said seal;
communicating said annular space to said running string through at least one port in a connector that holds said swage assembly to said running string and said second zone.

8. The method of claim 6, comprising:
creating a second zone between said swage assembly and said shoe whose volume increases as said first string is pushed by pressure applied in said first zone;
pressurizing said second zone through said running string while openings in said shoe are held closed to add a boost force to said first string above pressure applied to said seal in said first zone.

9. The method of claim 6, comprising:
tagging said cement shoe with said swage assembly after partial expansion of said first string;
cementing said first string through said swage assembly and said shoe;
displacing fluid with said cementing through a gap between said first string and the surrounding string.

10. The method of claim 9, comprising:
releasing said swage assembly from said shoe after said cementing;
circulating out excess cement with flow through said running string that exits adjacent the top of said first string through a port in an assembly that retains said seal by bypassing said seal.

11. The method of claim 10, comprising:
closing said gap by driving said swage assembly with pressure delivered through said running string between said shoe and said swage assembly and with the anchoring of said running string disabled.

12. The method of claim 11, comprising:
reconfiguring said swage assembly to a smaller expansion diameter after closing said gap;
running said swage assembly to the top of said first string to complete joining to the surrounding tubular.

13. The method of claim 12, comprising:
engaging said swage assembly to said seal;
releasing said seal from said now expanded first tubular;
removing said swage assembly, seal and anchoring device with said running string.

14. The method of claim 1, comprising:
using a packer cup as said seal;
expanding said first string into a recess in an existing string to create a monobore.

15. The method of claim 3, comprising:
performing a first part of the expansion of said first string by moving said first string over said swage assembly with said swage assembly stationary and a second part of the expansion while driving said swage assembly through said first string with said first string secured to a surrounding tubular.

16. The method of claim 15, comprising:
performing said first and second parts of said expanding using fluid pressure as the driving force.

17. The method of claim 16, comprising:
pushing said swage assembly from a second chamber defined between said swage assembly and a cement shoe in said first string and accessed by said running string to expand said first string to said existing tubular.

18. The method of claim 6, comprising:
forming said swage assembly with two wedge rings that selectively extend to differing diameters;
selectively expanding with one or both swages built to the maximum diameter.

19. The method of claim 18, comprising:
building or collapsing at least one of said wedge rings with applied pressure or mechanical impact.

20. The method of claim 1, comprising:
moving at another time said first string in tandem with said swage using pressure on said seal.

21. The method of claim 1, comprising:

said swage assembly is selectively adjustable to at least two expansion dimensions.

22. The method of claim 16, comprising:

pushing said first string by pressurizing a first chamber defined by said seal;

pulling tension on said running string to advance said swage assembly to connect said first string to the existing string.

23. The method of claim 1, comprising:

making at least a portion of said running string out of coiled tubing.

* * * * *